US011578917B2

(12) United States Patent
Plitzko et al.

(10) Patent No.: US 11,578,917 B2
(45) **Date of Patent: *Feb. 14, 2023**

(54) PROCESS LINE FOR THE PRODUCTION OF FREEZE-DRIED PARTICLES

(71) Applicant: Sanofi Pasteur SA, Lyons (FR)

(72) Inventors: Matthias Plitzko, Neuenburg (DE); Manfred Struschka, Auggen (DE); Thomas Gebhard, Kandern (DE); Bernhard Luy, Freiburg (DE)

(73) Assignee: Sanofi Pasteur SA, Lyons (FR)

( * ) Notice: Subject to any disclaimer, the term of this patent is extended or adjusted under 35 U.S.C. 154(b) by 299 days.

This patent is subject to a terminal disclaimer.

(21) Appl. No.: 16/697,217

(22) Filed: Nov. 27, 2019

(65) Prior Publication Data

US 2020/0109896 A1 Apr. 9, 2020

Related U.S. Application Data

(63) Continuation of application No. 14/348,850, filed as application No. PCT/EP2012/004167 on Oct. 4, 2012, now Pat. No. 10,527,350.

(30) Foreign Application Priority Data

Oct. 5, 2011 (EP) ..... 11008058

(51) Int. Cl.
*F26B 5/06* (2006.01)
*F26B 25/00* (2006.01)

(52) U.S. Cl.
CPC ..... *F26B 5/06* (2013.01); *F26B 25/00* (2013.01); *F26B 25/002* (2013.01)

(58) Field of Classification Search
CPC ..... F26B 5/06; F26B 25/002; F26B 25/00
See application file for complete search history.

(56) References Cited

U.S. PATENT DOCUMENTS 2,388,917 A 11/1945 Hormel
2,445,120 A * 7/1948 Levinson ..... F26B 5/06 34/245

(Continued)

FOREIGN PATENT DOCUMENTS

CN 2224384 4/1996
CN 101680714 3/2010

(Continued)

OTHER PUBLICATIONS

Applicant-Initiated Interview Summary dated Oct. 18, 2018 From the US Patent and Trademark Office Re. U.S. Appl. No. 14/348,850. (3 pages).
Applicant-Initiated Interview Summary dated Mar. 20, 2019 From the US Patent and Trademark Office Re. U.S. Appl. No. 14/348,850. (3 pages).

(Continued)

*Primary Examiner* — Jessica Yuen

(57) ABSTRACT

A process line for the production of freeze-dried particles under closed conditions is provided, the process line comprising a freeze-dryer for the bulkware production of freeze-dried particles under closed conditions, the freeze-dryer comprising a rotary drum for receiving the frozen particles, and a stationary vacuum chamber housing the rotary drum, wherein for the production of the particles under closed conditions the vacuum chamber is adapted for closed operation during processing of the particles; the drum is in open communication with the vacuum chamber; and at least one transfer section is provided for a product transfer between a separate device of the process line and the freeze-dryer, the freeze-dryer and the transfer section being separately adapted for closed operation, wherein the transfer section comprises a temperature-controllable inner wall surface.

22 Claims, 7 Drawing Sheets

(56) References Cited

U.S. PATENT DOCUMENTS

| | | | | |
|---|---|---|---|---|
| 2,751,687 | A * | 6/1956 | Colton | A23F 5/32 264/28 |
| 3,303,578 | A | 2/1967 | Rockwell et al. | |
| 3,936,952 | A | 2/1976 | Schimpfle | |
| 4,421,020 | A | 12/1983 | Gross | |
| 10,527,350 | B2 * | 1/2020 | Plitzko | F26B 25/00 |
| 2003/0000228 | A1 * | 1/2003 | Leuenberger | F26B 5/065 34/301 |
| 2003/0014879 | A1 | 1/2003 | Horigane | |
| 2008/0000362 | A1 * | 1/2008 | Ringstrom | B01D 5/0006 99/485 |
| 2008/0142166 | A1 * | 6/2008 | Carson | B01D 9/0027 159/4.01 |
| 2009/0215000 | A1 | 8/2009 | Boots et al. | |
| 2010/0107437 | A1 * | 5/2010 | Ogata | F26B 5/065 34/287 |
| 2014/0230266 | A1 | 8/2014 | Luy et al. | |
| 2014/0237846 | A1 | 8/2014 | Plitzko et al. | |
| 2014/0245629 | A1 | 9/2014 | Luy et al. | |
| 2014/0373383 | A1 | 12/2014 | Struschka et al. | |
| 2015/0007445 | A1 | 1/2015 | Gebhard et al. | |

FOREIGN PATENT DOCUMENTS

| | | |
|---|---|---|
| DE | 19654134 | 8/2003 |
| DE | 102005020561 | 11/2006 |
| DE | 102007012795 | 4/2008 |
| DE | 112008000296 | 5/2010 |
| EP | 0699645 | 3/1996 |
| FR | 799659 | 6/1936 |
| FR | 1002719 | 3/1952 |
| FR | 1378749 | 11/1964 |
| GB | 1031874 | 6/1966 |
| JP | 08-104588 | 4/1996 |
| JP | 2004-232883 | 8/2004 |
| JP | 2010-517738 | 5/2010 |
| WO | WO 2006/008006 | 11/2006 |
| WO | WO 2009/109550 | 9/2009 |
| WO | WO 2013/050156 | 4/2013 |
| WO | WO 2013/050157 | 4/2013 |
| WO | WO 2013/050158 | 4/2013 |
| WO | WO 2013/050161 | 4/2013 |
| WO | WO 2013/050162 | 4/2013 |

OTHER PUBLICATIONS

European Search Report and the European Search Opinion dated Jul. 25, 2012 From the European Patent Office Re. Application No. 11008058.7.

International Preliminary Report on Patentability dated Jan. 9, 2014 From the International Preliminary Examining Authority Re. Application No. PCT/EP2012/004167.

International Search Report and the Written Opinion dated Nov. 9, 2012 From the International Searching Authority Re. Application No. PCT/EP2012/004167.

Notice Of Allowance dated Aug. 28, 2019 From the US Patent and Trademark Office Re. U.S. Appl. No. 14/348,850. (5 pages).

Notice of Panel Decision from Pre-Appeal Brief Review dated Dec. 28, 2016 From the US Patent and Trademark Office Re. U.S. Appl. No. 14/348,850. (2 pages).

Official Action dated Mar. 3, 2015 From the US Patent and Trademark Office Re. U.S. Appl. No. 14/348,850. (10 Pages).

Official Action dated Aug. 9, 2018 From the US Patent and Trademark Office Re. U.S. Appl. No. 14/348,850. (10 pages).

Official Action dated Jan. 11, 2019 From the US Patent and Trademark Office Re. U.S. Appl. No. 14/348,850. (5 pages).

Official Action dated Nov. 13, 2014 From the US Patent and Trademark Office Re. U.S. Appl. No. 14/348,850. (10 Pages).

Official Action dated Nov. 17, 2017 From the US Patent and Trademark Office Re. U.S. Appl. No. 14/348,850. (18 pages).

Official Action dated May 21, 2019 From the US Patent and Trademark Office Re. U.S. Appl. No. 14/348,850. (7 pages).

Official Action dated Aug. 25, 2016 From the US Patent and Trademark Office Re. U.S. Appl. No. 14/348,850.

Official Action dated Mar. 26, 2018 From the US Patent and Trademark Office Re. U.S. Appl. No. 14/348,850. (10 pages).

Official Action dated Mar. 28, 2016 From the US Patent and Trademark Office Re. U.S. Appl. No. 14/348,850.

Official Action dated Jun. 29, 2017 From the US Patent and Trademark Office Re. U.S. Appl. No. 14/348,850. (19 pages).

Partial European Search Report dated Mar. 20, 2012 From the European Patent Office Re. Application No. 11008058.7.

Relatorio de Busca e Parecer [Search Report and Opinion] dated Jan. 15, 2020 From the Servico Publico Federal, Ministerio da Economia, Instituto National da Propriedade Industrial do Brasil Re. Application No. BR112014008000-3. (4 Pages).

* cited by examiner

PROCESS LINE FOR THE PRODUCTION OF FREEZE-DRIED PARTICLES

RELATED APPLICATIONS

This application is a Continuation of U.S. patent application Ser. No. 14/348,850 filed on Mar. 31, 2014, which is a National Phase of PCT Patent Application No. PCT/EP2012/004167 having International filing date of Oct. 4, 2012, which claims the benefit of priority of European Patent Application No. 11008058.7 filed on Oct. 5, 2011. The contents of the above applications are all incorporated by reference as if fully set forth herein in their entirety.

FIELD AND BACKGROUND OF THE INVENTION

The invention relates to the general field of freeze-drying of, for example, pharmaceuticals and other high-value goods. More specifically, the invention relates to a process line for the production of freeze-dried particles and methods for the bulkware production of freeze-dried particles under closed conditions wherein the freeze-dryer comprises a rotary drum.

Freeze-drying, also known as lyophilization, is a process for drying high-quality products such as, for example, pharmaceuticals, biological materials such as proteins, enzymes, microorganisms, and in general any thermo- and/or hydrolysis-sensitive materials. Freeze-drying provides for the drying of the target product via sublimation of ice crystals into water vapor, i.e., via the direct transition of at least a portion of the water content of the product from the solid phase into the gas phase. Freeze-drying is normally performed under vacuum (i.e., low pressure) conditions, but works generally also under different pressure conditions, e.g., atmospheric pressure conditions.

Freeze-drying processes in the pharmaceutical area may be employed, for example, for the drying of Active Pharmaceutical Ingredients ("APIs"), drugs, drug formulations, hormones, peptide-based hormones, carbohydrates, monoclonal antibodies, blood plasma products or derivatives thereof, immunological compositions including vaccines, therapeutics, other injectables, and in general substances which otherwise would not be stable over a desired time span. In order for the freeze-dried product to be stored and shipped, the water (or other solvent) has to be removed prior to sealing the product in vials or containers for preserving sterility and/or containment. In the case of pharmaceuticals and biological products, the freeze-dried (lyophilized) product may be reconstituted later by dissolving the product in a suitable reconstituting medium (e.g., pharmaceutical grade diluent) prior to administration, e.g., injection.

A freeze-dryer is generally understood as a process device employed in a process line for the production of freeze-dried particles such as granules or pellets with sizes ranging typically ranging from several micrometer to several millimeters. The process line may be under closed conditions, i.e., under the requirement of protecting sterility of the product, or under the requirement of containment, or both. Production under sterile conditions prevents contaminants from entering into the product. Production under containment means that neither the product, elements thereof, nor any auxiliary or supplementary materials enter the environment.

Implementing a process line to run under closed conditions is a complex task. Therefore a general need exists for design concepts that reduce the complexity of process lines and process devices such as freeze-dryers. Reducing the complexity of the process lines and process devices enables more cost-effective production of pharmaceuticals and/or bio-pharmaceuticals and other high-quality goods.

Various design approaches for constructing freeze-dryers are known. In one example, DE 10 2005 020 561 A1 describes the production of freeze-dried round particles in a drying chamber that includes a fluidized bed. In this device, a process gas with the appropriate temperature flows from below the bed via a bottom screen through the drying chamber. The process gas is dehumidified, such that the process gas absorbs humidity such that it consequentially removes product humidity via sublimation. While the design allows careful drying of round particles with amorphous structure the need for a dehumidified process gas leads to the relatively high costs seen in using this approach.

WO 2006/008006 A1 describes a process for sterile freezing, freeze-drying, storing, and assaying of a pelletized product. The process comprises creating frozen pellets in a freezing tunnel, which are then directed into a drying chamber, wherein the pellets are freeze-dried on a plurality of pellet-carrying surfaces; the pellets are thus dried as bulkware, i.e., before the filling thereof into vials. From the feeding tunnel, the pellets are distributed by feeder channels onto the pellet carriers. Heating plates are arranged below each of the carriers. A vibrator is provided for vibrating the drying chamber during the drying process. Pelletizing and freeze-drying are performed in a sterile volume provided inside an isolator.

After freeze-drying, the pellets are unloaded into a storage container. While drying the pellets as bulkware provides for a higher drying efficiency than drying the pellets only after the dispensing them into vials, the other process lines elements of providing a drying chamber with multiple pellet carriers, having a complex arrangements of feeder channels and channels for de-loading the freeze-dryer, heating plates, and vibrating means leads to a complex arrangement that may be difficult to clean/sterilize, as well as having other potential drawbacks. Moreover, keeping the entire process line of droplet generator, freezing tunnel, and freeze-dryer within one isolator further adds to the complexity and costs associated of this design approach.

WO 2009/109550 A1 describes a process for stabilizing an adjuvant containing a vaccine composition in dry form. The process comprises prilling and freezing a formulation, bulk freeze-drying, and then dry dispensing the product into final recipient containers. The freeze-dryer comprises pre-cooled trays, that collect the frozen particles which are then loaded on pre-cooled shelves in the freeze-dryer. Once the freeze-dryer is loaded, a vacuum is pulled in the freeze-drying chamber to initiate sublimation of water vapor from the pellets. In addition to tray-based freeze-drying, a number of techniques, such as atmospheric freeze-drying, fluidized bed drying, vacuum rotary drum drying, stirred freeze-drying, vibrated freeze-drying, and microwave freeze-drying are indicated as being applicable options for the freeze-drying.

DE 196 54 134 C2 describes a device for freeze-drying products in a rotatable drum. The drum is heated and the sublimation vapor released from the product is drawn off the drum. The drum is filled with the bulk product and is slowly rotated in order to achieve a steady heat transfer between product and inner wall of the drum. The inner wall of the drum can be heated by a heating means provided in an annular space between the drum and a chamber housing the drum. Cooling can be achieved by a cryogenic medium inserted into the annular space. It is proposed that the device be used for pharmaceutical or biological materials. However, it is not specifically described how, for example, the sterility of the product is protected or achieved. Following the approach in WO 2006/008006 A1, an isolator would need to be provided for receiving the freeze-drying device of DE 196 54 134 C2 for a production under sterile conditions. This leads to a complex arrangement.

SUMMARY OF THE INVENTION

It is an object of the present invention to provide a process line for the production of freeze-dried particles under closed conditions, the process line comprising a freeze-dryer for the bulkware production of freeze-dried particles under closed conditions, wherein the freeze-dryer provides for an efficient drying process, correspondingly shorter drying times, and more cost-efficient production than presently obtainable using conventional methods and process devices.

According to one aspect of the invention, a process line for the production of freeze-dried particles under closed conditions with a freeze-dryer for the bulkware production of freeze-dried particles under closed conditions is provided to achieve one or more of the above-mentioned objects. In preferred embodiments, the freeze-dryer comprises a stationary vacuum chamber housing one or more rotary drums adapted for receiving the frozen particles. For the production or processing of particles under closed conditions, the vacuum chamber is adapted for closed operation during processing, and the drum is in open communication with the vacuum chamber.

As used herein, the term "production" includes, but is not limited to the production or processing of freeze-dried particles for commercial purposes, but also includes production for development purposes, test purposes, research purposes, and the like. In particular embodiments, the processing of particles in the drum comprises at least the steps of loading the particles to be dried into the drum, freeze-drying the particles in the drum, and unloading the dried particles from the drum. The particles may comprise granules or pellets, wherein the term "pellets" may refer preferably to particles with a tendency to be round, while the term "granules" may preferably refer to irregularly formed particles. In one example, the particles may comprise micropellets, i.e., pellets with sizes in the micrometer range. According to one specific example, the freeze-dryer may be adapted for the production of essentially round freeze-dried micropellets with a mean value for the diameters thereof selected from within a range of about 200 to 800 micrometers (μm), e.g., with a narrow particle size distribution of about ±50 μm around the selected value.

The term "bulkware" can be broadly understood as referring to a system or plurality of particles which contact each other, i.e. the system comprises multiple particles, microparticles, pellets, and/or micropellets. For example, the term "bulkware" may refer to a loose amount of pellets constituting at least a part of a product flow, such as a batch of a product to be processed in a process device such as a freeze-dryer or a process line including the freeze-dryer, wherein the bulkware is loose in the sense that it is not filled in vials, containers, or other recipients for carrying or conveying the particles/pellets within the process device or process line. A similar meaning holds true for the term "bulk."

The bulkware described herein will normally refer to a quantity of particles (pellets, etc.) exceeding a (secondary, or final) packaging or dose intended for a single patient. Instead, the quantity of bulkware may relate to a primary packaging, for example, a production run may comprise production of bulkware sufficient to fill one or more intermediate bulk containers ("IBC s").

The terms "sterility" ("sterile conditions") and "containment" ("contained conditions") are understood as required by the applicable regulatory requirement for a specific case. For example, "sterility" and/or "containment" may be understood as defined according to GMP ("Good Manufacturing Practice") requirements.

The freeze-dryer provides a process volume, within which process conditions such as pressure, temperature, humidity (i.e., vapour-content, often water vapour, more generally vapour of any sublimating solvent), etc., are controlled to achieve the desired process values over a prescribed time span, e.g., a production run. Specifically, the term "process conditions" is intended to refer to temperature, pressure, humidity, etc. in the process volume, wherein a process control may comprise controlling or driving such process conditions inside the process volume according to a desired process regime, for example, according to a time sequence of a desired temperature profile and/or pressure profile). While the "closed conditions" (sterile conditions and/or containment conditions) also are subject to process control, these conditions are discussed herein in many cases explicitly and separately from the other process conditions indicated above.

The desired process conditions can be achieved by controlling process parameters by means of implementing heating and/or cooling equipment, vacuum pumps, condensers, and the like. The freeze-dryer may comprise in connection to the vacuum chamber a vacuum pump and a condenser. The freeze-drying process in the process volume may be supported further by rotating the drum to increase the "effective" product surface, i.e., the product surface exposed and thus available for heat and mass transfer, etc.

Specifically, the term "effective product surface" is understood herein as referring to the product surface which is in fact exposed and therefore available for heat and mass transfer during the drying process, wherein the mass transfer may in particular include an evaporation of sublimation vapour. While the present invention is not limited to any particular mechanism of action or methodology, it is contemplated that rotation of the product during the drying process exposes more product surface area (i.e. increases the effective product surface) than conventional vial-based and/or tray-based drying methodologies (including, e.g., vibrated tray-drying). Thus, utilization of one or more rotary-drum-based drying devices can lead to shorter drying cycle times than conventional vial-based and/or tray-based drying methodologies.

According to various embodiments, the vacuum chamber provides the process volume. In one such embodiment, the vacuum chamber is adapted to operate under closed conditions, i.e., sterility and/or containment, and accordingly, the vacuum chamber comprises a confining wall. The confining wall is adapted to hermetically separate or isolate the process volume from an environment, thereby defining the process volume. The vacuum chamber may be further adapted for closed operation, for example: 1) while loading the drum with the particles; 2) freeze-drying the particles; 3) cleaning the freeze-dryer, and/or 4) sterilizing the freeze-dryer. The drum may be partially or totally confined within the process volume, i.e., the rotary drum may be arranged entirely, or partially, inside the process volume.

According to various embodiments, the confining wall of the vacuum chamber contributes to establishing and/or maintaining the desired process conditions within the process volume during, e.g., a production run and/or other operational phases such as a cleaning and/or sterilization.

In some embodiments, both the vacuum chamber and the drum contribute to providing the desired process conditions in the process volume. The drum can be adapted to assist in establishing and/or maintaining desired process conditions. For example, one or more cooling and/or heating means can be provided in and/or in association with the drum for heating and/or cooling the process volume.

Embodiments of the freeze-dryer designed for the production of particles under closed conditions include one or more means for feeding the frozen particles into the freeze-dryer under sterile conditions and/or containment conditions, and/or include one or more means for discharging the freeze-dried particles under sterile conditions and/or containment conditions from the freeze-dryer. Such dis-/charging means may comprise gates, ports, transfer sections, and the like.

According to various embodiments of the invention, the vacuum chamber comprises a temperature-controllable inner wall surface. In this respect, the vacuum chamber comprises a housing which is at least in part double-walled. In variants of these embodiments, the vacuum chamber is adapted for cooling the inner wall surface while loading the drum with particles. Additionally, or alternatively, the vacuum chamber is adapted for heating the inner wall surface in either, or both, of a freeze-drying process and a sterilization process.

According to various embodiments of the invention, the drum comprises a temperature-controllable inner wall surface. In this respect, the drum comprises a housing which is at least in part double-walled. In certain variations of these embodiments, the drum is adapted for heating an inner wall surface during the freeze-drying process. Additionally, or alternatively, the drum can be adapted for additional cooling of a wall, for example, an inner wall surface thereof, to assist the cooling of the process volume by the vacuum chamber inner wall while loading the drum with particles.

Embodiments of the invention contemplate employment of additional or alternative means for providing heat to the particles during a lyophilization process. According to particular embodiments, microwave heating can be employed. One or more magnetrons can be provided for generating microwaves which are coupled preferably into the drum by means of waveguides such as, for example, one or more metal tubes. According to one particular embodiment, a magnetron is provided in association with the vacuum chamber. A stationary metal tube of a diameter in the range of, for example, about 10 cm to 15 cm, guides the microwaves from the magnetron via the vacuum chamber into the drum. Preferably, the waveguide enters the drum via an opening in the front plate (or rear plate) thereof, for example via a charging/loading opening.

According to other embodiments, multiple magnetrons and/or waveguides can be employed. It is contemplated that, if alternative heating mechanisms such as microwave heating are employed, heating mechanisms for heating one or both of an inner wall of the drum and an inner wall of the vacuum chamber are optional; however, particular embodiments of a freeze-dryer according to the invention offer various/alternative heating mechanisms such as for example heatable inner walls of drum and/or vacuum chamber and microwave heating for flexible employment according to different desired process regimes.

When employing microwave heating, the waveguide and/or the magnetron may be hermetically separated from the process volume, for example, by a sealed barrier transparent for microwaves.

In some embodiments of the invention, at least one of the vacuum chamber and/or the rotary drum components are arranged to be self-draining with respect to one or more of cleaning and/or sterilization processes. One embodiment of the invention comprises a drum arranged to be inclined or inclinable for one or more of the steps of draining cleaning liquid(s) in the cleaning process, draining of sterilization liquid(s) and/or condensate(s) in a sterilization process, and/or discharge of the product following a freeze-drying process. Additionally, or alternatively, the vacuum chamber can be arranged to be inclined or inclinable for one or more of the steps of draining cleaning liquid(s) in the cleaning process and/or draining sterilization liquid(s) and/or condensate(s) in a sterilization process. In some variants of these embodiments, the vacuum chamber is adapted for draining liquids/condensates into a connection tube connecting the vacuum chamber with a condenser. In some embodiments, the drum and the chamber are arranged at mutually opposite inclinations.

According to various embodiments, the freeze-dryer is adapted to directly discharge the product inside the vacuum chamber into a final recipient under closed conditions. The freeze-dryer may be adapted for a docking/undocking of a recipient such as a container for filling, and/or the freeze-dryer can be adapted for a receiving of the recipient; for example, the vacuum chamber can be adapted for receiving one or more containers for filling, i.e., discharging of dried particles from the drum.

According to various embodiments of the invention, at least one of the vacuum chamber and the drum are adapted for Cleaning in Place ("CiP") and/or Sterilization in Place ("SiP"). In particular, one or both of the vacuum chamber and the drum can be adapted for steam-based SiP. In some embodiments of the invention, one or more access points are provided at a drum outer wall surface for directing a cleaning and/or sterilization medium onto the inner wall surface of the vacuum chamber. Additionally, or alternatively, access points may be provided at the vacuum chamber inner wall surface for directing a cleaning and/or sterilization medium(s) onto the outer wall surface of the drum and/or into the interior of the drum.

In accordance with a further aspect of the invention, a process line for the production of freeze-dried particles under closed conditions is provided, wherein the process line comprises a freeze-dryer as outlined herein. According to various embodiments of this aspect of the invention, at least one transfer section is provided for a product transfer between a separate device and the freeze-dryer, wherein each of the freeze-dryer and the transfer section(s) are separately adapted for closed operation. This implies that the freeze-dryer and/or transfer section(s) can be individually adapted or optimized for closed operation. For example, the freeze-dryer (the vacuum chamber thereof) can be individually adapted for sterile operation and, independently thereof, the transfer section can be individually adapted for protecting a sterile product flow. In specific embodiments, the transfer section is adapted for protecting sterility and/or keeping containment along a product flow extending through the transfer section into the rotary drum or out of the rotary drum/vacuum chamber of the freeze-dryer.

In certain embodiments, the transfer section can be permanently mechanically mounted to the vacuum chamber (according to other embodiments, a transfer section is detachably mechanically mounted to the vacuum chamber). For example, the transfer section may comprise a double-walled structure, wherein the outer wall is a confining wall hermetically isolating the inner "process volume" of the transfer section from an environment, and the outer wall is mounted to the vacuum chamber in order to ensure hermetic connection to the freeze-dryer. An inner wall of the transfer section may form, for example, a guiding means such as a tube for guiding a product flow into or out of the freeze-dryer, for example a rotary drum of the freeze-dryer. The inner wall of the transfer section need not be in engagement with the vacuum chamber and/or rotary drum of the freeze-dryer. For example, as the drum is in open communication with the vacuum chamber, the drum can be provided with an opening for a guiding means of the transfer section extending into the drum.

In a specific embodiment, a first transfer section is provided for a product transfer from a separate process line device for the production of frozen particles to the freeze-dryer. The first transfer section may comprise a charging funnel protruding into the open drum without engagement therewith. Additionally, or alternatively, a second transfer section may be provided for a product transfer from the freeze-dryer to a separate device of the process line for discharging the freeze-dried particles.

In variants of the invention, the freeze-dryer comprises at least one discharge guiding means for guiding freeze-dried particles to be discharged from the open drum via the vacuum chamber to the above-indicated second transfer section. Such guiding means can be arranged inside the drum and/or externally of the drum inside of the vacuum chamber. When arranged inside the drum, a part or all of the guiding means may be adapted for mixing of the bulk product when the drum is rotated in one rotational direction, and for serving a discharging when the drum is rotated in another rotational direction.

One or more transfer sections of the device can be adapted for gravity transfer of the product (and/or other conveyance mechanisms, such as auger-based, pressure-based, pneumatic-based mechanisms). Generally, a transfer section for a product transfer between separate devices of the process line under closed conditions incorporates more functionality than a simple guiding means such as a tube or funnel. In a first regard, specific process conditions can be maintained along the flow path, e.g., with respect to a desired temperature, and in a second regard, product transfer is conducted under closed conditions, e.g., the transfer section may be adapted to protect sterility. Similarly, a transfer section for a product transfer between separate devices of the process line under closed conditions incorporates more functions/functionality than an isolator comprising one or more simple guiding means such as a tube or funnel, as a conventional isolator is not typically adapted for maintaining specific process conditions. Specifically, in typical configurations seen in the field, the walls of an isolator provide hermetic closure of an enclosed volume, but are not adapted for maintaining desired process conditions inside the volume.

Embodiments of a transfer section according to the invention may comprise a temperature-controllable inner wall surface. For example, in cases where the transfer section comprises a double wall, as exemplified above, either an inner surface of an outer wall or an inner surface of an inner wall forming guiding means such as a tube or funnel for a product flow can be designed or engineered to be temperature-controllable. In certain embodiments of a process line comprising multiple transfer sections, one or more of the transfer sections are adapted for active temperature control, while one or more other transfer sections are not. For example, a transfer section provided for discharging freeze-dried particles from the freeze-dryer may not be specifically adapted for active temperature control, as particles after drying do not normally need specific cooling, while the transfer section guiding frozen particles for drying into the freeze-dryer can be adapted for active temperature control, in particular cooling, in order to provide optimum process conditions and thus prevent or retard undesired product characteristics developing from, e.g., agglomeration of frozen particles.

A transfer section according to the invention can comprise a valve or similar sealing/separation means for sealably separating the freeze-dryer from other devices of the process line. The freeze-dryer can be adapted for separate closed operating conditions including, but not limited to, particle freeze-drying, and cleaning and/or sterilization of the freeze-dryer. For example, in case of a separate freeze-drying operation performed under separation from other process devices, the freeze-dryer may require dedicated equipment for controlling process conditions such as the pressure. In these embodiments, the dedicated equipment can include, but is not limited to, one or more vacuum pumps, that are not separated by sealing operation of one or more transfer sections guiding the product flow into and/or out of the freeze-dryer.

According to still further embodiments of the invention, a process for the bulkware production of freeze-dried particles under closed conditions is provided, wherein the process is performed using a freeze-dryer as outlined and understood herein. The process may comprise at least the following steps: 1) loading frozen particles to a drum of the freeze-dryer; 2) freeze-drying the particles in the rotary drum that is in open communication with a vacuum chamber of the freeze-dryer; and 3) discharging the particles from the freeze-dryer. The vacuum chamber of the freeze-dryer can be operated under closed conditions during processing of the particles.

The process may further comprise one or more steps of controlling the temperature of an inner wall surface of at least one of a vacuum chamber and the drum. In some embodiments, the drum is rotated not only in the drying step, but also in the loading step. According to variants of these embodiments, the drum is rotated in the loading step with an altered, e.g., slower, rotational velocity as compared to the drying step.

ADVANTAGES OF THE INVENTION

The invention provides inter alia design and engineering concepts for devices for the production of freeze-dried bulk particles under closed conditions. With regard to sterile product handling, the present freeze-dryer can be operated in an unsterile environment without the need for an additional isolator. The added complexity and costs related to the employment of an isolator can therefore be avoided while still providing for product sterility according to, for example, Good Manufacturing Practice ("GMP") requirements. According to certain embodiments, a boundary is provided by the vacuum chamber of the inventive freeze-dryer, such as a confining wall confining or defining the process volume. The boundary can be adapted to function as a conventional isolator and/or to contribute to establishing or maintaining desired process conditions in the process volume such as establishing and maintaining a desired temperature regime, pressure regime, etc.

In preferred embodiments, an isolator is not required for providing an operation under closed conditions with the freeze-dryer according to the invention. Accordingly, in these embodiments, conventional isolators as typically employed in the field are not appropriate for implementing a freeze-dryer and/or process line according to the design principles of the present invention. In contrast to conventional designs, for instance, an isolating means of an isolator (e.g., an isolating wall thereof) would have to be adapted to not only provide hermetic isolation or separation between an inside and an outside, but would also have to be adapted at least to contribute to controlling desired process conditions in the inside.

More specifically, in conventional freeze-drying process lines after initially establishing sterile conditions inside the isolator (e.g., according to GMP requirements), the operator must confirm every hour or every few hours that sterility is actually being maintained inside the isolator. This situation requires employing costly sensor equipment and monitoring procedures. As described herein, the present invention avoids these costly equipment requirements and monitoring procedures. Accordingly, in particularly preferred embodiments, production costs are considerably reduced as compared to conventional freeze-dryers/freeze-drying process lines employing isolators. Similar cost reductions can be realized with regard to containment requirements in freeze-drying processes.

According to another example, the confining wall or similar process volume defining means of the vacuum chamber is designed in order to avoid, as much as possible, critical areas particularly prone to contamination or pollution. In preferred embodiments, the vacuum chamber and/or drum are specifically adapted for efficient cleaning and/or sterilization. In a conventional freeze-drying scenario, it is not feasible for the isolator and an outer surface of processing equipment arranged within the isolator to be specifically designed in this respect.

The housing/vacuum chamber may be seen as being particularly devoted to providing a process volume and a separating or isolating means for the process volume from the environment, while the drum may be seen as being particularly devoted to providing for an efficient sublimation of water vapor from the particles. Such separation of tasks enables separate optimization thereof and reduces potential interferences. As the functions of providing process conditions, and sterility/containment can be separated in part or entirely from the drum, the rotatability thereof can be ignored when optimizing these functions. This simplifies drum design and thus eventually enables broad application of drum-based freeze-dryers. For example, consider a case where the rotary drum for receiving the particles is in open communication with a housing chamber (vacuum chamber). Process conditions inside the process volume can be established/maintained by the stationary chamber instead of by the rotary drum. This simplifies the design with regard to process control means such as heating/cooling equipment, heating/cooling media, and/or equipment for providing (vacuum) pressure conditions to the process volume. In one example, the need to couple a stationary vacuum pump to the rotary drum by a complex sealing means is avoided since the pump only needs to be coupled to the stationary chamber.

As a further example, providing the drum in open connection with the chamber simplifies loading the rotary drum with the particles. A complex sealing means for the stationary equipment, e.g., loading funnels, extending into the rotatable drum are not required.

While the present invention is not intended to be limited to any mechanism, employing a rotary drum for particle drying increases the effective product surface which in turn accelerates mass and heat transfer, as compared to drying of particles at rest (consider, for example, conventional vial-based drying or bulkware drying in stationary trays). More specifically, in cases of in-vial freeze-drying, the increased availability of product surface provided by the rotational motion of the drum allows for more efficient mass and heat transfer than is seen in in-vial drying of product. For example, due to the increased product surface, mass and heat transfer need not take place through the frozen product because there are less material layers slowing down a diffusion of water vapor as compared to drying in vials. Furthermore, no stoppers are present to hinder the release and removal of the water vapor. With bulkware drying the need for loading and unloading vials vanishes, which in turn leads to simplified design and/or increased flexibility options for the freeze-dryer. As the filling step can be performed after freeze-drying, specific vials, stoppers, containers, IBCs ("Intermediate Bin Containers"), etc., are generally not required. Bulk drum-based drying can lead to more homogeneous drying conditions for the entire batch.

Either one, or both, of vacuum chamber and drum may comprise a temperature-controllable wall. This feature enables efficient temperature control for operation under closed conditions and may avoid or reduce employment of other cooling/heating means, such as equipment for providing a flow of dry, cool, and typically sterile gas via the process volume, and/or heating equipment such as radiators, heating plates, etc., inside the process volume. This feature is contemplated to decrease the complexity and costs of the freeze-dryer and/or the process line in which the freeze-dryer may be employed.

Various embodiments of the invention can flexibly be provided with one or more heating mechanisms. For example, for heating particles during lyophilization, in addition or as an alternative to a heatable drum and/or vacuum chamber walls, microwave heating (and/or still other heating mechanisms) could be provided. It is to be noted that microwave heating approaches often suffer from the problem of microwave field inhomogeneities which can occur on wavelength scales, e.g., on scales of about 10 cm to 15 cm. These scales are larger than particle sizes (at or below centimeter scales) and therefore can result in some particles receiving excessive energy transfer and overheating, melting, and even burning while particles receive too low of a heat transfer with result being delayed sublimation.

One measure to overcome the inhomogeneity problem can be to provide multiple magnetrons and/or multiple waveguides reaching into the freeze-drying cavity, e.g. the drum (or the vacuum chamber). However, according to specific embodiments of the invention, a single magnetron and a single waveguide for guiding the microwaves into the drum via, for example, a front opening of the drum (e.g., the charging opening) is sufficient. Without wishing to be bound to any theory, the impact of field inhomogeneities inside the drum can be minimized in comparison to freeze-drying stationary particles (e.g., vial based drying, and/or tray-based drying, including vibrated drying), as with drum-based drying the particles are in permanent movement due to the rotation of the drum. As long as the paths of the particles in the microwave field are at least of the order of the wavelength of the microwaves, a generally substantially uniform particle heating results.

Generally, embodiments of the freeze-dryer according to the invention can flexibly be tailored to specific process requirements, e.g., desired process regimes. Depending on the details of one or more process regimes desired to be performed by the device, it may be sufficient to provide only one of the chamber or the drum with a temperature-controllable wall. In other applications, for example in cases where the freeze-dryer is intended to be used for a broad range of process regimes, both the drum and chamber can be equipped with temperature-controllable walls. In one example, the drum can be configured to provide additional or supplementary temperature control over those provided by the chamber.

Temperature control may include applying cooling, for example, prior to and/or during loading of the drum with particles. Additionally, or alternatively, temperature control may include applying heating, for example, during the lyophilization process and/or during a supplementary process such as a sterilization.

Providing the chamber and/or drum with a heating means for heating a wall, e.g., an inner wall (optionally an outer wall of the drum) provides several advantages, such as reduction of mechanical stresses and/or shortened transition times for transitioning from one operational mode to another (for example, transitioning from a freeze-drying to a cleaning and/or sterilization mode). Such transitions can involve hot steam being applied to structures kept during the drying at temperatures around, e.g., −60° C. Heating of, for example, the inner walls of the chamber and/or the drum allows smooth adaptation of presently cold structures prior to applying steam thereto, and thereby enables to considerably shorten timescales compared to a passive warming after termination of the drying process. Similarly, an active cooling means can considerably shorten cooling times following a cleaning and/or sterilization process involving high temperatures. According to one specific example, a passive cooling time for a given configuration may be from 6-12 hours, which can be shortened to around 1 hour (or less) by active cooling of, for example, one or more walls of chamber and/or drum.

Structural entities referred to herein as transfer sections are described herein as an option for providing for the transfer of particles into and/or out of the freeze-dryer under closed conditions, i.e., under protection of sterility and/or provision of containment conditions. One design approach including such entities enables flexibility when integrating the freeze-dryer with further, separate devices into a process line. A transfer section may provide for: 1) isolation from an environment, i.e., providing closed conditions; 2) desired process conditions, e.g. via cooling; and 3) guiding the flow of product from one device to another. These (and other) tasks can be accomplished by different components of a transfer section. For example, a double-walled transfer section may comprise a hermetically closed outer wall for providing closed conditions, which may correspondingly be connected to an outer wall of the vacuum chamber, while an inner wall of the transfer section comprises a funnel, tube, pipe or similar guiding means for the particles. The guiding means may extend via the wall or walls of the chamber into the drum, with or without engagement with the drum. The assignment of tasks to different structural components in the freeze-dryer and/or the transfer section thus enables a simplified yet efficient design.

As the process volume is provided primarily by the housing (vacuum) chamber of the freeze-dryer, freeze-dryer devices according to embodiments of the invention can flexibly be adapted to one or more of various kinds of discharging facilities and discharging recipients, into which the dried particles are filled. After unloading the particles from the drum, the particles can be directly filled under closed conditions provided by the chamber into containers received in or docked to the chamber. Alternatively, a transfer section can be provided for guiding the particles into a separate product handling section for discharge and/or other product handling operations. Guiding means for guiding the product flow from the drum to the recipients and/or the transfer section can be flexibly provided within the process volume encompassed by the closed conditions provided by the stationary chamber.

The freeze-dryer according to the invention may generally be employed for drying a broad spectrum of particles such as granules or pellets of different sizes and/or size ranges. The freeze-dryer according to the invention may be flexibly operated in a batch mode, for example, for freeze-drying a batch of particles, and/or may be operated in a continuous mode, for example, during a loading phase the freeze-dryer may continuously receive frozen partides from an upstream particle generation device, prevent agglomeration of the received particles, and provide for an appropriate cooling. This is but one illustration of the flexibility provided by one or more of the embodiments of the present invention.

At least one of the chamber and the drum can be adapted for CiP and/or SiP, which simplifies cleaning and/or sterilization, and contributes to shortened maintenance times between production runs, etc. In this regard, the freeze-dryer according to the invention can be specifically adapted for efficient cleaning/sterilization. For example, the drum, the chamber, or both can be inclined for draining cleaning and/or sterilization liquids and/or condensates from the respective devices. In certain embodiments, an existing opening in the confining wall of the process volume can be re-used for draining, for example, an opening for a connection to the condenser, thereby providing a simple yet efficient design.

Generally, full ability for CiP/SiP enables a freeze-dryer design wherein the process volume can be kept permanently hermetically closed, i.e., integrated, by simple means such as welded or bolted connections, which enables a cost-efficient design and performance when compared to devices which require manual intervention and/or disassembly for, e.g., cleaning and/or sterilization purposes, and are thus correspondingly restricted in their design.

BRIEF DESCRIPTION OF THE SEVERAL VIEWS OF THE DRAWINGS

Further aspects and advantages of the invention will become apparent from the following description of particular embodiments illustrated in the figures, in which.

DESCRIPTION OF SPECIFIC EMBODIMENTS OF THE INVENTION

Figure 1:
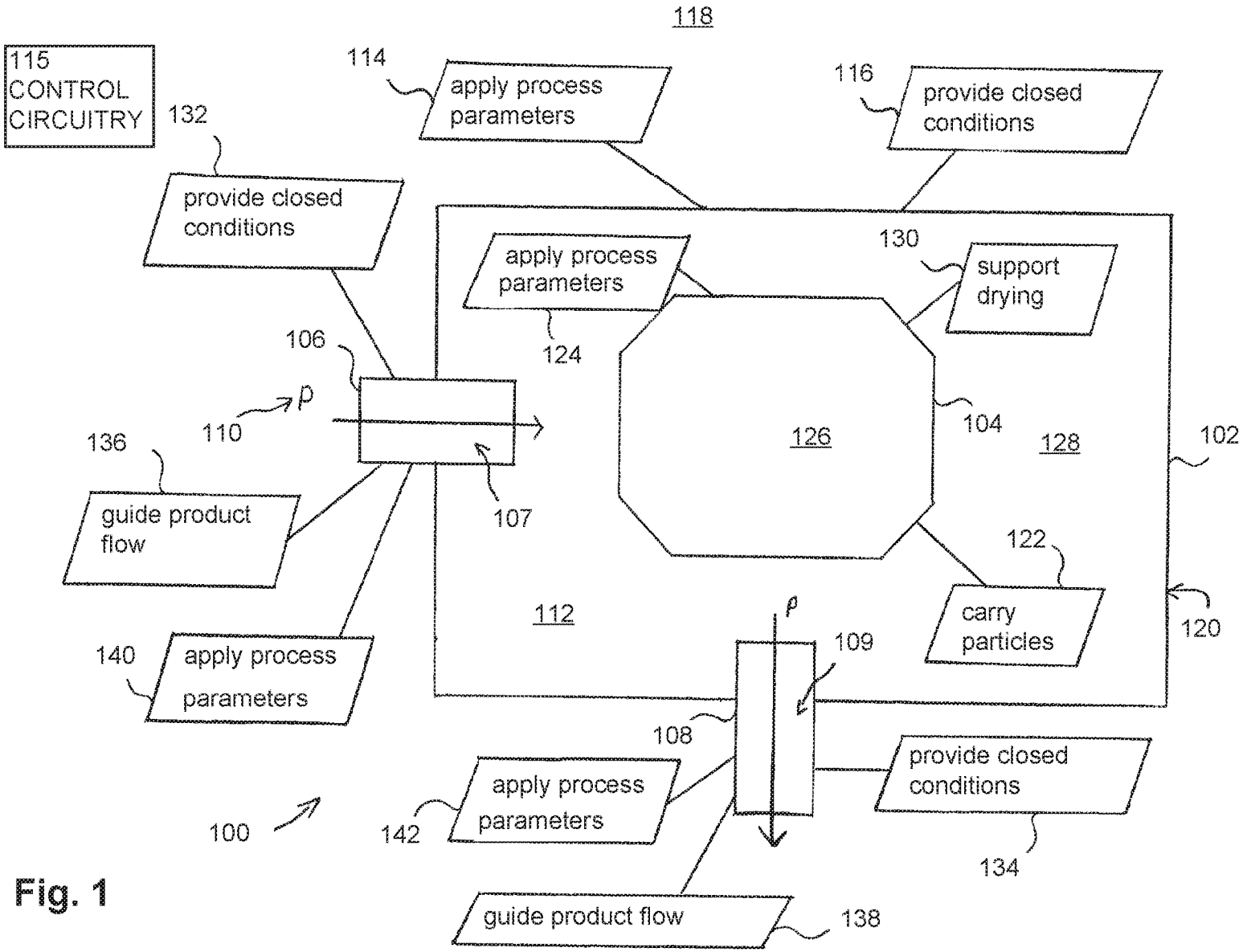
FIG. 1 is a schematic illustration of a first embodiment of a freeze-dryer according to the invention.

FIG. 1 schematically illustrates components of embodiment 100 of a freeze-dryer, wherein an assignment of functions to the components and an interworking thereof is indicated. The freeze-dryer 100 can be employed in a process line for the bulkware production of freeze-dried particles under closed conditions. The freeze-dryer 100 comprises a housing chamber 102 and a drum 104, and is connected with transfer sections 106 and 108 for a transfer of the product P/110 into and out of a process volume 112, respectively.

It is the task 114 of housing chamber 102 to define the process volume 112 and establish/maintain process conditions such as pressure, temperature, humidity, etc., within desired values inside process volume 112, which includes that housing chamber 102 is equipped with means to control appropriate process parameters accordingly in order to provide a desired process regime to the volume 112 in a well-defined, reliable, and repeatable way.

In one embodiment, housing chamber 102 is adapted for providing vacuum conditions to process volume 112, wherein "vacuum" is understood as denoting a low pressure or an underpressure below an atmospheric pressure, as is known to the skilled person. Vacuum conditions as used herein may mean a pressure as low as 10 millibar, or 1 millibar, or 500 microbar, or 1 microbar. It should be noted that lyophilization may generally be performed in different pressure regimes and may, for example, be performed under atmospheric pressure. Many of the freeze-dryer configurations described herein nevertheless include a housing chamber housing a rotary drum, wherein the housing chamber is implemented as a vacuum chamber, as lyophilization may efficiently be performed under vacuum. Therefore, housing chamber 102 in FIG. 1 is denoted hereinafter as being a "vacuum chamber", although it is to be understood that a vacuum chamber is but one embodiment of a general housing chamber which may be considered appropriate for implementing the design concepts discussed herein.

Generally, the housing (vacuum) chamber 102 operates to establish or maintain predefined process conditions in process volume 112 via the application of process parameters the control thereof generally indicated as function block 114 in FIG. 1. Referring to a process condition "vacuum", the condition can be established/maintained by controlling equipment associated with vacuum chamber 102, such as a vacuum pump, according to appropriate control parameters, wherein there may be some feedback regulation of process conditions as measured in or in association to process volume 112 in order to set process control parameters accordingly. Illustration of optional sensor circuitry as well as feedback regulation circuitry is omitted from FIG. 1. A vacuum pump is but one of a plurality of equipment devices which could possibly be applied at or in association with vacuum chamber 102 in FIG. 1, however, the vacuum pump is also omitted from the figure for clarity.

With regard to a process condition "temperature" inside the process volume 112, in preferred embodiments, temperature control (heating and/or cooling) means are provided in association with vacuum chamber 102. Suitable temperature control means may comprise the application of a cooling medium, heating medium, radiation heat (wherein the radiation can be microwave radiation, for example), electrical heat, etc. to the process volume 112, either indirectly via an inner wall surface of vacuum chamber 102 and/or directly via application to the interior of the vacuum chamber 102 (i.e., the process volume 112). For example, heating energy may be radiated directly into the process volume. Appropriate parametric control of heating and/or cooling means preferably falls under function block 114, for example, using control circuitry 115.

With regard to a process condition "humidity", i.e., a content of water vapor of the process volume 112, a condenser can be provided (omitted in FIG. 1) in association with vacuum chamber 102, i.e., in temporary or permanent communication with process volume 112. For example, during a production run (i.e., a drying of the particles "P"), in order to establish and maintain a process condition of a predefined value for the humidity in volume 112, one or more of the process parameters 114 can be related to the operation of the condenser.

The tasks illustrated within box 114 in FIG. 1 may not only refer to an operation of the vacuum chamber 102 during a freeze-drying but also to other processes/operational modes. For example, the freeze-dryer 100 can be operated in a charging or loading mode, wherein particles P are guided in a quasi-continuous way from an upstream particle generator (e.g., a spray-freezer, prilling tower, etc.) via transfer section 106 to freeze-dryer 100. The product therefore flows with the particle generation rate into the freeze-dryer, i.e., the drum 104 is loaded with the particle generation rate. In the loading mode, process conditions may comprise a similar pressure as in the upstream particle generator, and/or may comprise a pressure of the order of an atmospheric pressure (and/or a pressure in the transfer section 106). A temperature in process volume 112 may also be controlled similar to a temperature in the particle generator (and/or a temperature in the transfer section 106). Depending on the details of the particle generation, in the loading mode a humidity of the process volume 112 may or may not actively be controlled.

The functions 114 may further comprise control of process parameters for a cleaning mode and/or a sterilization mode. In one embodiment, the freeze-dryer 100 is equipped with one or more means such as cleaning/sterilization access points (e.g., nozzles, multi-nozzle heads, etc.) as well as one or more draining means for implementing CiP and/or SiP for the vacuum chamber 102. It is to be noted that such access points need not necessarily be arranged directly at the vacuum chamber; for example, means for directing a cleaning/sterilization medium to structures such as an inner wall of the vacuum chamber 102 can be arranged in association with the drum 104 housed in chamber 102. Control of parameters related to the flow of cleaning/sterilization medium to the access points can be part of the functions 114. Similarly, parameters related to the pressure and/or temperature control means discussed above can also be actively controlled in the cleaning/sterilization mode, and/or in a transition mode for the transition from one of the above discussed modes to another. For example, a cooling of the vacuum chamber after cleaning/sterilization and/or a heating of the chamber 102 after a drying process can optionally be shortened by active temperature control.

It is to be understood that the functions 114 preferably include, but do not require, the execution of control schemes, procedures or predetermined programs which implement a specific process regime or processing via the definition of time sequences for relevant control parameters.

Besides the role or task (set of tasks, function block) 114 of controlling process conditions in volume 112 in various operational modes, the vacuum chamber 102 has also associated therewith the role 116 of separating or isolating process volume 112 from an environment 118 of the volume 112. Functions related to task 116 may relate to at least one of protecting a sterility condition inside process volume 112 (including or not particles P, e.g., after or before loading) and providing containment for the interior of chamber 102, i.e., preventing any material transfer from process volume 112 to the environment 118, be it solid, liquid, gaseous, (drug)

product or excipients, pollution or attrition. In order for implementing task 116, chamber 102 may comprise a partially or completely hermetically closed wall 120. Wall 120 may essentially define the process volume 112 as the interior or inside thereof. Wall 120 may comprise a single wall, a double wall, or a combination thereof.

For example, in certain embodiments, wall 120 is hermetically closed with a minimum of well-defined openings for a transfer of matter and energy internal to and out of process volume 112 as well as mechanical support for structures facing into process volume 112. The openings in wall 120 may comprise multiple transfer sections 106 and 108, the above-mentioned cleaning/sterilization medium access points, one or more drainage openings for removing cleaning and/or sterilization remnants, and sensor openings. The function block 116 may comprise an active control of valves and/or other sealing means arranged at or in association with one or more of the above openings, and may also comprise functions related to determination/sensing whether desired closed conditions are in fact established or maintained within process volume 112.

Turning to the drum 104 and the various functions ascribed thereto, it is noted that drum 104, in preferred embodiments, can be loaded with particles P in a loading mode wherein certain embodiments thereof have been discussed already above. The particles can be carried and kept in the rotating drum 104 during a drying mode and subsequently unloaded from the drum/discharged from the freeze-dryer 100 in an unloading/discharge mode. Consequently, one of the tasks (roles, function blocks) assigned to drum 104 is the task 122 of receiving and carrying particles P transferred into the freeze-dryer 100 via transfer section 106. The task 122 may for example be achieved by an appropriate design of the drum to receive and keep the desired amount of particles. Further, an inclination of the drum may be actively controlled to enable one or more of loading, drying, and unloading. For example, the drum 104 can be inclined from a general default position for unloading of the particles, and can thereafter be moved back into the default position. The active functions of role 122 may also comprise sensing bulk properties including detecting a loading level and/or detecting a degree of particle agglomeration as well as sensing particle properties such as temperature or humidity.

Function block 124 in FIG. 1 illustrates that drum 104 may further comprise or be equipped with one or more means to assist in controlling process conditions in process volume 112 during one or more of the various operational modes of the freeze-dryer 100. In principle, the control of process conditions can be assigned to one or both of vacuum chamber 102 and drum 104 as both are in direct contact with process volume 112. However, it is contemplated that for many applications the vacuum chamber 102 may take over the major part of controlling process conditions (function block 114) while the drum 104 assists (function block 124), if required, as corresponding process parameter control equipment may generally preferably be arranged at or in association to the stationary chamber instead of to the rotary drum for cost-effective design.

The supplementary process condition control functions 124 can therefore be seen as optional. For example, the rotary drum 104 may optionally be equipped with means for controlling a pressure or a humidity in process volume 112. In this respect it is noted that drum internal volume 126 can be kept in permanent communication with external volume 128 (both volumes 126 and 128 being understood as forming together the process volume 112) with regard to transfer of material and energy such that, for example, pressure, temperature, and humidity conditions generally balance in volumes 126 and 128. While the present invention is not limited to any particular mechanisms or theories of operation, it is contemplated that in principle keeping the drum and chamber in open communication would not hinder controlling pressure and/or humidity via the drum, however this may not generally be a preferred option.

The task 124 may comprise a (supplementary) temperature control within process volume 112. For example, in some embodiments, one or more heating and/or cooling means can be arranged at or otherwise associated with drum 104 in order to assist corresponding temperature control means (function 114) of vacuum chamber 102. For example, heating means can be provided to assist in heating process volume 112 and/or particles P, and/or cooling means can be provided for an additional cooling during a loading phase. It is contemplated that temperature control means at the drum 104 can replace corresponding means at the chamber 102.

Supporting an efficient drying of particles P is indicated as an extra role 130 of drum 104 in FIG. 1. In this respect, it is noted that one or more advantages related to design principles as discussed herein may also be achieved by employing a particle carrier comprising one or more stationary or vibrating trays for receiving the particles filled in vials or as bulkware. However, it is considered to be a preferred design option with a view on efficiency in terms of drying times, drying results, production costs, etc., to employ a rotary drum as the particle carrier. For this reason the component 104 is referred to as drum 104, while it is to be understood that in general other particle carriers may additionally, or alternatively, be employed depending on circumstances such as, e.g., batch size, desired drying efficiency and drying time, and allowable humidity content of the particles after drying, etc.

Further examples of functions included in task 130 comprise that the drum can be specifically adapted for supporting a large product surface during drying, which may include an appropriate rotation velocity of the drum as well as further measures supporting an efficient revolution and mixing of the particles. In this regard, typical rotation velocities during a freeze-drying process include, but are not limited to, between about 0.5-10 rotations per minute (rpm), preferably between 1-8 rpm, while the rotational velocity during a loading in one embodiment can be set to around 0.5 rpm.

As a further example, a control function relates to keeping the product surface area high by preventing agglomeration of particles during loading, which in turn can be achieved by, e.g., keeping the drum 104 in (slow) rotation during loading. Controlling process conditions according to role 124 also is contemplated to further support efficient drying. Therefore some measures may be arbitrarily assigned to one or the other of tasks 124 and 130; this may relate for example to the application of heat to drum volume 126.

It is to be noted that any function related to providing closed conditions to process volume 112, such as protecting sterility of particles P is preferably assigned to the chamber 102 with role 116. Such assignment(s) enable(s) the drum 104 to be designed to be in open communication with chamber 102 with the corresponding advantages discussed herein.

The transfer sections 106 and 108 have assigned tasks 132 and 134, respectively, to provide for a transfer of particles into and out of the process volume 112 under closed conditions, i.e., under protection of sterility and/or containment. The tasks 132 and 134 may comprise functions similar to what has been described with respect to task 116 of vacuum chamber 102. For example, transfer sections 106 and 108 can be designed to provide a hermetic separation between an interior 107 and 109 of sections 106 and 108 and an environment such as environment 118 in order to protect sterility and/or containment. The interiors 107 and 109 may then further be adapted for tasks 136 and 138 of conveying the product and guiding the product flow into/out of process volume 112. The provision of closed condition for a separated operation of freeze-dyer 100 may also belong to tasks 132 and 134, which can be implemented by one or more sealing means adapted for controllably establishing a hermetic closure of interiors 107 and 109 of transfer sections 106 and 108, resulting in a cut of any product flow and moreover preventing any material transfer into or out of process volume 112 along interiors 107 and 109.

Transfer sections 106 and 108 may optionally be further assigned a task 140 and/or 142 of applying appropriate "process" conditions to interiors 107 and 109 of sections 106 and 108. For example, according to task 140 transfer section 106 can be adapted to control a temperature in the interior 107 via appropriate cooling means. For transfer section 108, an active cooling mechanism may no longer be required such that task 142 may not comprise temperature control functions. With regard to a cleaning/sterilization process, the tasks 140 and 142 may comprise applying a cleaning/sterilization medium to interiors 107 and 109 via appropriate piping and cleaning/sterilization medium access points. Similar control functions may also be included in roles 114 and 124 for the chamber and the drum, respectively, which leads to the freeze-dryer 100 being CiP/SiP-enabled.

It is to be generally understood that part or all of, for example, the tasks 114, 124, 140 and 142 may be realized by executing predefined control schemes, procedures or programs specifying timely sequences of driving relevant control parameters, thereby implementing a specific desired process regime.

Figure 2:
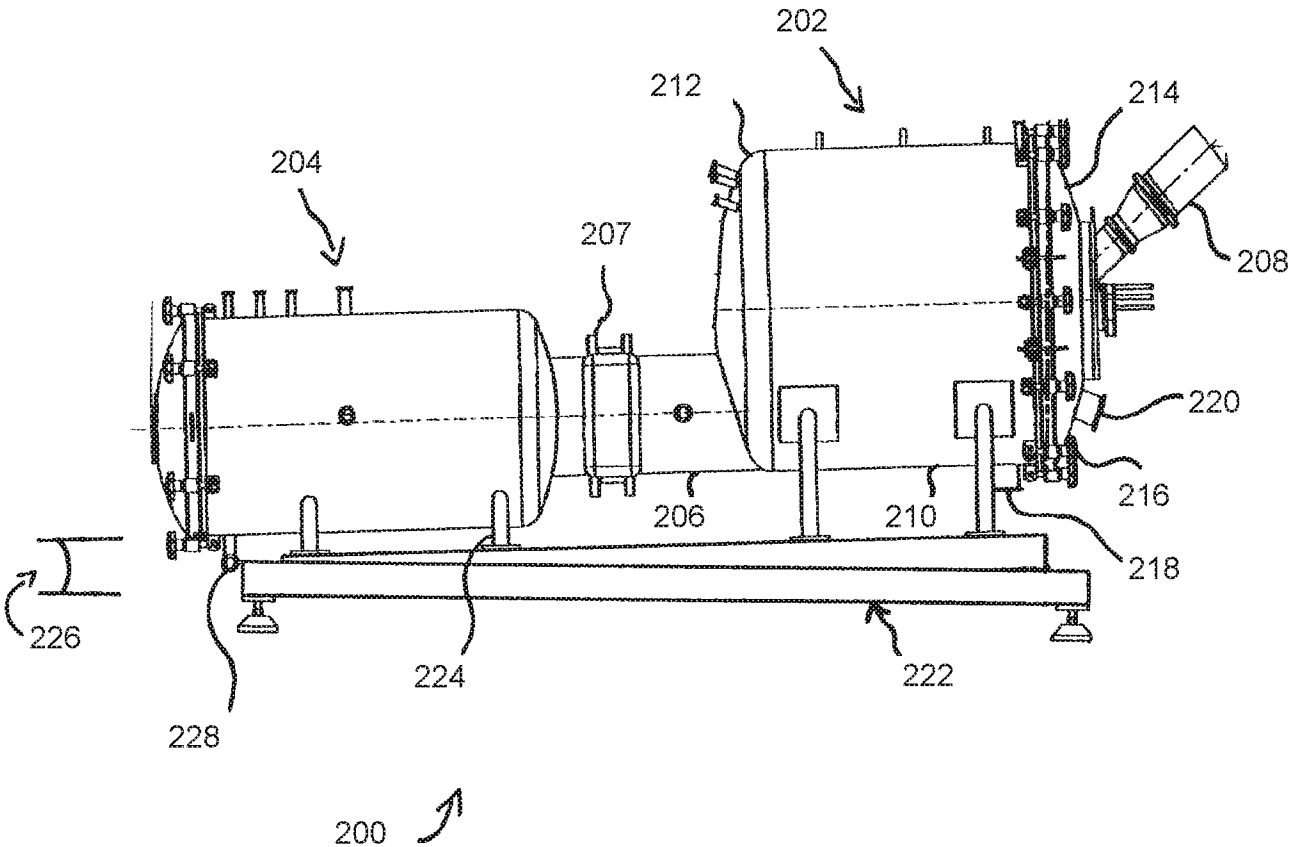
FIG. 2 is a schematic illustration of a second embodiment of a freeze-dryer in a side view.

FIG. 2 is a side view of an embodiment 200 of a freeze-dryer comprising a vacuum chamber 202 and condenser 204 interconnected by a tube 206 equipped with valve 207 for controllably separating chamber 202 and condenser 204 from each other. A vacuum pump may optionally be provided in association with condenser 204 or tube 206. A transfer section 208 is provided for loading the freeze-dryer 200 with frozen particles. The transfer section 208 can be connected or connectable associated with a separate device of a process line and/or a container or other storage device for storing particles to be processed under closed conditions.

In various embodiments, both vacuum chamber 202 and condenser 204 are generally cylindrical shaped. Specifically, the vacuum chamber 202 may comprise a cylindrical main section 210 terminated with cones 212 and 214, which may either be permanently fixedly mounted with main section 210 (as exemplarily shown for cone 212), or may be removably mounted, as exemplarily shown by cone 214 mounted with a plurality of bolted fastenings 216 to main section 210. In some of the embodiments, transfer section 208 is permanently connected to end cone 214 for guiding a product flow into vacuum chamber 202 under closed conditions. Each of main section 210 and cone 214 of vacuum chamber 202 comprise a port 218 and 220, respectively, for a product discharge from vacuum chamber 202 which may be achieved at least in part by gravity (optionally assisted by one or more active conveyance mechanisms).

Figure 3:
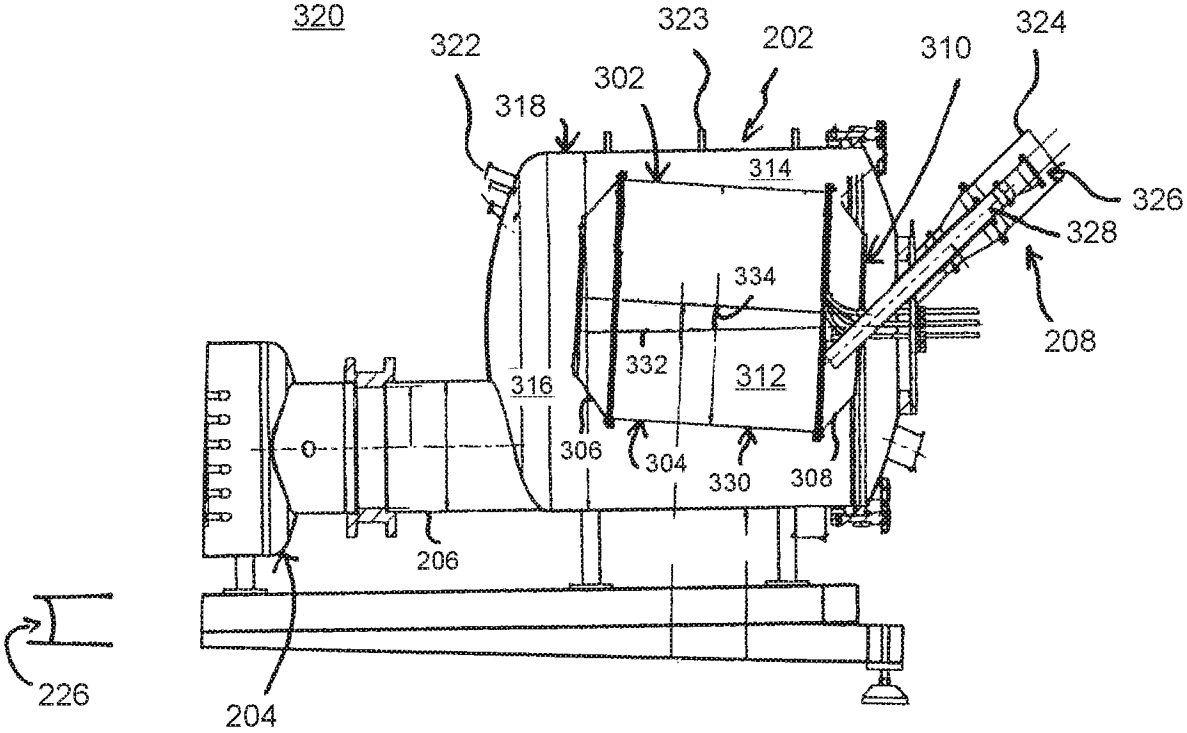
FIG. 3 is a schematic cross-sectional view illustrating details of the freeze-dryer of FIG. 2.

FIG. 3 illustrates a cross-sectional cut-out of freeze-dryer 200 of FIG. 2 showing aspects related to the vacuum chamber 202 in more detail. Specifically, the chamber 202 houses a rotary drum 302, the rotational support thereof being omitted in FIG. 3 for clarity. Drum 302 is preferably of generally cylindrical shape with a cylindrical main section 304 terminated by cones 306 and 308. Drum 302 is adapted for receiving frozen pellets via transfer section 208.

An opening 310 is provided in cone 308. Via opening 310 internal volume 312 of drum 302 is preferably in open communication with external volume 314 inside vacuum chamber 202. Therefore, process conditions such as pressure, temperature, and/or humidity tend to equalize between volumes 312 and 314; thus, even if there are differences in the process conditions between both volumes in an ongoing process, e.g., due to heating applied only inside or only outside the drum, volumes 312 and 314 can be understood as forming together process volume 316 of chamber 202.

Similarly, as has been described with reference to the high-level embodiment 100 of FIG. 1, also in freeze-dryer embodiment 200 illustrated in FIGS. 2 and 3 the vacuum chamber 202 has been assigned the task to provide closed conditions for the process volume 316 confined within/defined by a wall 318 of chamber 202, i.e., to protect sterility and/or provide containment with respect to an environment 320. Wall 318 is implemented as a hermetically closed wall with any opening therein being hermetically sealed or sealable with respect to the environment 320. Tube 206 as well as condenser 204 are also hermetically closed.

Further, in some embodiments, vacuum chamber 202 is adapted to provide functions to achieve process conditions within process volume 316 according to a desired process regime by controlling appropriate process parameters. In this respect, chamber wall 318 can for example be equipped with one or more cooling/heating means, sensor circuitry for sensing process conditions inside process volume 316, cleaning/sterilization means, etc. (and/or support means such as supporting arms for supporting one or more of the aforementioned means), as illustrated by connection ports 322 and 323 for corresponding tubing/wiring. Wall 318 may be single-walled, or may be double-walled. With regard to controlling pressure conditions, a vacuum pump for evacuating process volume 316 to a desired under-pressure may be operating via tube 206, but is nevertheless also regarded as an "equipment" of vacuum chamber 202.

Additional, or alternative, heating means can be provided according to other embodiments. For example, in addition or as an alternative to heating means provided for heating inner wall surfaces of vacuum chamber 202 and/or drum 302, a magnetron can be provided for generation of microwave radiation, which is then guided by a waveguide tube into drum 302. The tube can traverse a vacuum chamber wall and process volume 316 to enter into, e.g., opening 310 of drum 302. According to some embodiments, heatable drum and/or vacuum chamber walls can be omitted if microwave heating is available.

In a preferred embodiment, transfer section 208 has double walls with outer wall 324 providing closed conditions if desired within an inner volume 326. Outer wall 324 can be permanently connected with wall 318 of vacuum chamber 202 as one aspect contributing to providing closed conditions. Inner wall 328 forms a charging funnel extending through inner volume 326 and into process volume 316 of vacuum chamber 202. As closed conditions are provided by outer wall 324 a sterile product can be conveyed via charging funnel 328 into chamber 202.

More specifically, in certain embodiments charging funnel 328 protrudes into drum 302 which therefore is directly loaded via funnel 328. Cone 308 and opening 310 are preferably adapted such that a desired load of particles can be received and carried in rotating drum 302. Further adaptations of drum 302 for carrying particles may comprise controlling an inclination of drum 302 and may comprise still further measures as known to the person of skill in the field. Opening 310 can be designed such that charging funnel 328 may extend into drum 302 without any engagement therewith. While the present invention is not intended to be limited to any particular mechanism, it is contemplated that no such (e.g., sealing) engagement of stationary funnel 328 with rotating cone 310 is required, as it is not the drum 302, but the chamber 202 which controls process conditions for the drum-internal portion 312 of process volume 316; consequently, a sealing engagement for providing closed conditions is required only between transfer section 208 (more precisely, its outer wall 324) and stationary vacuum chamber 202, simplifying and/or providing more flexibility to the design of freeze-dryer 200.

As drum 302 is contained within process volume 316, it may flexibly be adapted for assisting in providing desired process conditions within process volume 316. Additional cooling and/or heating means may for example optionally be provided in association with drum wall 330.

Figure 4:
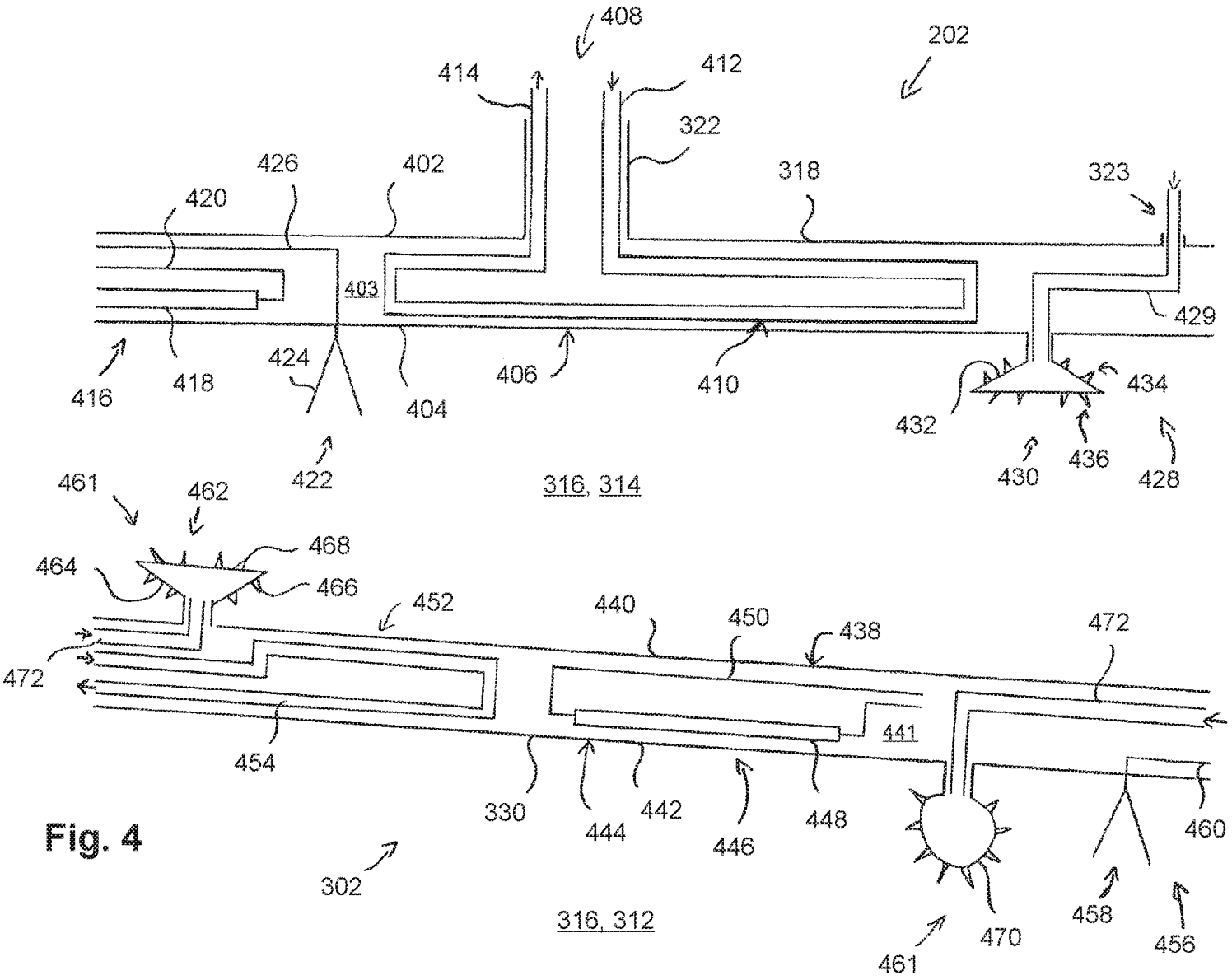
FIG. 4 illustrates details of the vacuum chamber and drum of the freeze-dryer of FIG. 3.

FIG. 4 illustrates sections of wall 318 of vacuum chamber 202 as well as wall 330 of drum 302. In the embodiment illustrated with FIG. 4, vacuum chamber wall 318 is a double wall comprising outer wall 402 and inner wall 404 with inner wall surface 406 facing process volume 316. Inner wall surface 406 is preferably temperature-controllable via one or more cooling and heating means. Specifically, a cooling circuitry 408 is provided which is shown in FIG. 4 as comprising a tube system 410 extending throughout at least part of internal volume 403 inside double wall 318. Tube system 410 is connected between a cooling medium inflow 412 and cooling medium outflow 414. Tubing 410 may enter and leave double wall 318 via one of ports 322 already illustrated in FIG. 3. Tubing 410 may be externally connected with additional equipment such as a cooling medium reservoir, pumps, valves, and control circuitry 115 for cooling the process volume 316 as required for a prescribed process regime. In particular, the control circuitry and/or cooling circuitry 408 can be adapted for a cooling of the inner wall surface 406 during a loading of drum 302 with particles.

In the embodiment illustrated in FIG. 4, double wall 318 is further equipped with heating circuitry 416 exemplarily implemented by one or more heating coils 418 with corresponding power supply circuitry 420. The power supply can optionally be controlled by control circuitry 115 for heating the process volume 316 and 314 as required for a prescribed process regime. For example, the control circuitry 115 and/or heating circuitry 416 can be adapted for heating the inner wall surface 406 during a freeze-drying process, a cleaning process and/or a sterilization process.

The aforementioned control circuitry 115 may comprise circuitry 422 including sensor equipment 424 arranged at inner wall 404 for sensing process conditions within process volume 316 and 314 and connected via linings 426 to remote control components of the process control circuitry 115. Sensor equipment 424 may include, for example, sensor elements for sensing conditions such as pressure, temperature, and/or humidity and the like.

In preferred embodiments, sterilization equipment 428 is provided including piping 429 within wall 318 (typically, for cleaning and sterilization separate equipment can be provided, however only one such system is illustrated in FIG. 4). The sterilization piping 429 provides sterilization medium supply for sterilization medium access points 430, wherein for example steam can be used as a sterilization medium. Access point 430 can be implemented as a multi-nozzle head 432 with a plurality of nozzles wherein some of the nozzles 434 can be directed towards inner wall surface 406 for sterilization thereof and other nozzles 436 can be directed towards an outer surface 438 of wall 330 of drum 304 for sterilization thereof. A system for providing a cleaning medium to the inside of process room 316 and 314 can be implemented similarly as described here for the sterilization equipment 428.

Turning to drum 304, the wall 330 thereof can also be implemented as a double wall with outer surface 438 of outer wall 440 thereof directed towards inner wall surface 406 of inner wall 404 of vacuum chamber 202, while inner wall 442, more precisely inner wall surface 444 thereof, defines the volume 312 internal to drum 304, which nevertheless is part of the common process volume 316.

In still further embodiments, drum 302 may additionally comprise a temperature-controllable inner wall surface 444 as specified in the following. Double wall 330 can contain heating equipment 446 shown as being implemented by heating coils 448 and corresponding power supply 450 in FIG. 4, which can be adapted for (e.g., additional) heating of the inner wall surface 444 during a freeze-drying process, cleaning process, and/or sterilization process. Further, double wall 330 contains cooling equipment 452 including tubing 454 for guiding a cooling medium along at least portions of the inside 441 of drum double wall 312. Cooling equipment 452 can be adapted for an (additional) cooling of inner wall surface 444 facing towards inner volume 312 of drum 302 during loading of the drum 302 with particles.

A cooling medium employed in system 408 for cooling inner wall surface 406 of the housing/vacuum chamber 202 may, for example, comprise, but is not limited to, nitrogen ($N_2$) or a nitrogen/air mixture, or a brine/silicone oil mixture. In addition or alternatively to the heating equipment 416 illustrated in FIG. 4, for example, heating coils as commonly known in the field can be employed for heating. In one embodiment, the inner wall surface temperatures of a housing/vacuum chamber is controllable within a range of about −60° C. to +125° C. A temperature control associated with the drum 302 can be provided similarly as discussed before for the housing/vacuum chamber 202. Additionally, or alternatively, utilization of a gaseous cooling and/or heating medium is possible and within the skill in the art. Electrical heating means to be applied within double walls 318 and/or 330 of housing/vacuum chamber 202 and/or drum 302 can additionally, or alternatively, comprise foils enabling uniform provisioning of heat as well as other similarly functioning devices and/or materials.

Control circuitry 115 for controlling operation of freeze-dryer 200 may comprise sensor equipment 456 arranged at inner wall 442 for sensing process conditions within inner drum volume 312, wherein equipment 456 comprises sensor elements 458 connected via sensor linings 460 to central control components of the control circuitry 115. Temperature probes can also optionally be provided inside the drum in proximity to the product being dried and may for example be provided at main section 304 of drum 302, and/or at the terminating cones 306 and 308.

In preferred embodiments, double wall 330 further contains cleaning/sterilization equipment referenced generally with numeral 461. A plurality of cleaning and/or sterilization medium access points 462 can provide a cleaning/sterilization medium such as steam to the process volumes 316 and 314. The access point 462 can be implemented as a multi-nozzle head 464 comprising nozzles 466 directed towards outer wall surface 438 and comprising nozzles 468 directed towards inner wall surface 406 of wall 318 of vacuum chamber 202 for cleaning/sterilization thereof. Further, sterilization equipment 461 also preferably comprises multi-nozzle heads 470 directed towards inner volume 312 and 316 in drum 302 for cleaning/sterilization of inner wall surface 444 of drum double wall 330. One or more cleaning/sterilization medium(s) can be conveyed in any case to the access points 462 and 470 via piping 472. It is noted that nozzles 436 of sterilization system 428 associated with wall 318 of vacuum chamber 202 on the one hand, and nozzles 468 of sterilization system 460 associated with wall 330 of drum 302 implement a specific aspect of a system for SiP for a freeze-dryer comprising a housing chamber housing a rotary drum.

It is generally noted that drum 302 comprises single wall portions and double wall portions. For example, drum 302 may comprise single wall cones 306 and 308 (See, e.g., FIG. 3) and may comprise a double-walled main section 304.

Figure 5:
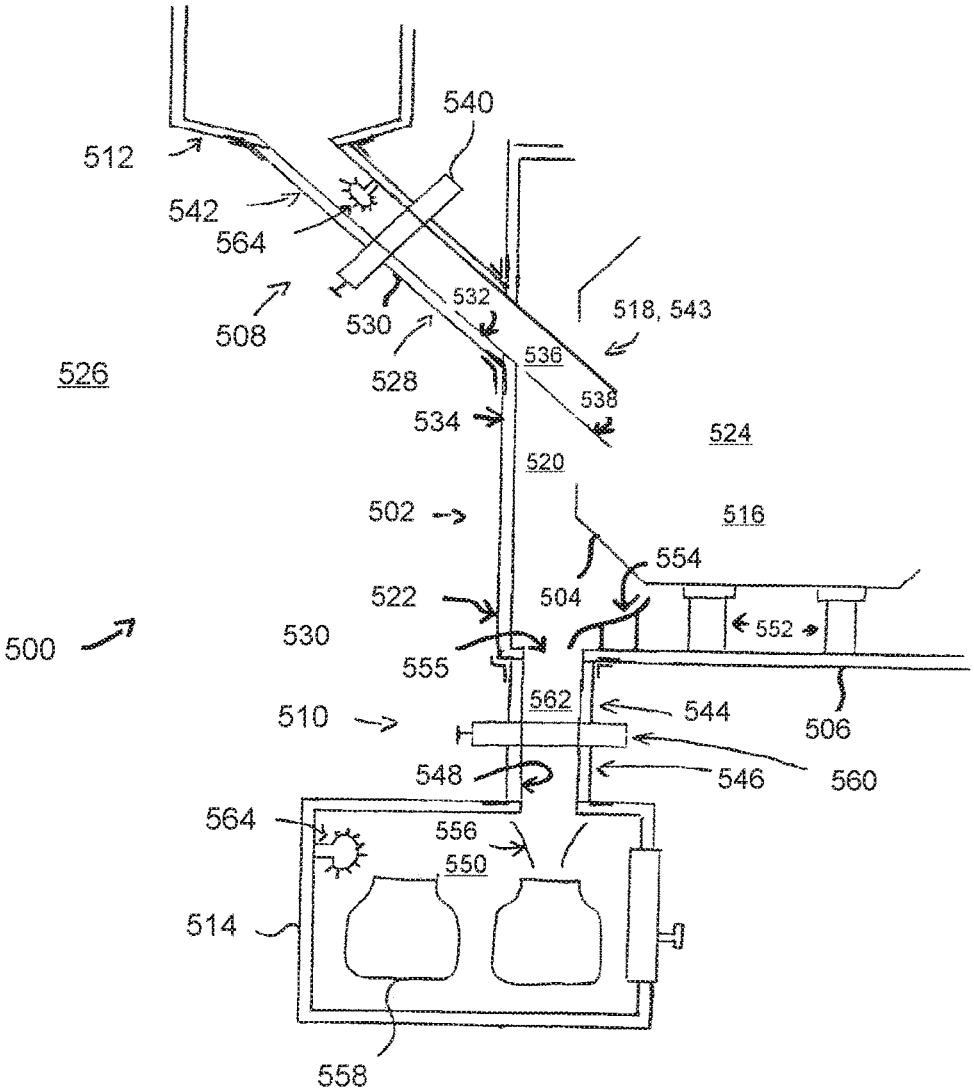
FIG. 5 illustrates in part a process line comprising a freeze-dryer according to the invention.

FIG. 5 illustrates an exemplary embodiment 500 of a process line including a freeze-dryer 502 comprising a rotary drum 504 housed in a vacuum chamber 506. Various properties of the freeze-dryer 506 may be similar to those of freeze-dryer 200 illustrated in FIGS. 2 and 3. However, in FIG. 5 transfer sections 508 and 510 are illustrated connecting freeze-dryer 502 to process devices 512 and 514 of line 500.

In a preferred embodiment, internal volume 516 of drum 504 is in communication via opening 518 with external volume 520 confined within double walls 522 of vacuum chamber 506, internal 516 and external 520 volume forming together process volume 524 of freeze-dryer 502. Wall 522 confining entire process volume 524 is hermetically closed and therefore is enabled for providing for processing under closed conditions, i.e., protection of sterility and/or containment with regard to an environment 526 of freeze-dryer 500.

Transfer section 508 is provided for guiding a product flow from spray chamber 512 to the freeze-dryer 502, wherein the spray chamber 512 is but one exemplary embodiment of a particle generator and is only schematically represented in FIG. 5. Spray chamber 512 may be embodied as any kind of spraying and/or prilling device known in the field including, for example, a spraying/prilling chamber, and/or tower, and/or a cooling/freezing tunnel, and the like.

Transfer section 508 preferably comprises double wall 528 with outer wall 530 and inner wall 532. For guiding the product flow from spray chamber 512 to freeze-dryer 502 (similar to task 136 of FIG. 1), inner wall 532 of double wall 528 of transfer section 506 forms a charging funnel extending into drum 504 without engagement therewith. Outer wall 530 of double wall 528 is adapted for providing closed conditions (See task 132).

In order to achieve end-to-end closed conditions for the production of freeze-dried particles in process line 500, among other features outer wall 530 is preferably in hermetically closed mounting connection to spray chamber 512 and to freeze-dryer 502. Specifically, outer wall 530 of double wall 528 is mounted with outer wall 534 of double wall 522 of vacuum chamber 506, the mounting contributing to hermetic closure of both internal volumes, i.e., process volume 524 and transfer volume 536 inside transfer section 508. Besides being connected for providing comprehensive closure for the entire process line 500, it is to be noted that of freeze-dryer 500, transfer section 508, and the further devices 512, 514/transfer sections 510 of process line 500 each are separately adapted for an operation under closed conditions, for example by providing the hermetically closed vacuum chamber 506 in case of freeze-dryer 500, or by providing hermetically closed outer wall 530 in case of transfer section 506. End-to-end closed conditions for process line 500 are achieved without any additional isolator(s).

As illustrated in FIG. 5, transfer section 508 is adapted for a gravity transfer of frozen particles from spray chamber 512 to freeze-dryer 500. While not shown in detail in FIG. 5, double wall 528 of transfer section 508 can be adapted for providing desired process conditions in transfer volume 536 (See task 106 in FIG. 1). For example, inner wall 532 may comprise a temperature-controllable inner wall surface 538. Specifically, and similarly to what has been exemplarily described above for double walls 318 and 330 of vacuum chamber 202 and rotary drum 302, respectively, in FIG. 4, double wall 528 may contain cooling equipment for cooling inner wall surface 538 during at least a product transfer from spray chamber 512 via transfer section 508 to freeze-dryer 500, and/or may comprise heating equipment for heating inner wall surface 538 during at least a cleaning and/or sterilization of transfer section 508. Corresponding cooling and/or heating may also be applied in order to shorten time scales for an adaptation of transfer section 508 to desired process conditions, i.e., minimize cooling or heating times required for limiting mechanical stress in a transition between processes, e.g., in a transition from a production process to a cleaning/sterilization process or vice versa. Similarly as illustrated in FIG. 4, transfer section 508 may also be adapted for CiP/SiP.

In some embodiments, transfer section 508 comprises valve 540 for configurably sealably separating freeze-dryer 502 from spray chamber 512. In a closed state, valve 540 can provide closed conditions to both devices 502 and 512 connected to transfer section 508, i.e., inflow section 542 and outflow section 543 protruding into drum 504 are hermetically closed from each other and therefore form a closed, blind tube from the perspective of each of a process volume inside spray chamber 512 and process volume 524 of freeze-dryer 502, respectively.

Transfer section 510 connects freeze-dryer 502 with succeeding discharge section 514. Briefly, transfer section 510 is noted to share various structural, functional, and design aspects as seen in transfer section 108 of FIG. 1. Transfer section 510 comprises a double wall 544 with outer wall 546 permanently mechanically mounted to vacuum chamber 506 on the one side and discharge section 514 on the other side in order to provide for a closed connection therein between with respect to protecting sterility and/or providing containment. Inner wall 548 forms a tube within which freeze-dried particles are guided from process volume 524 and 520 of freeze-dryer 502 to process volume 550 provided by discharge section 514.

For discharging particles from freeze-dryer 502 after a termination of a freeze-drying process, freeze-dried particles can be unloaded from drum 504 according to one or more of various techniques in the field. For example, with or without ongoing rotation, drum 504 can be inclined by correspondingly controlling supporting piles 552. Schematically indicated discharge guiding means 554 are provided for guiding the freeze-dried particles from the opening 518 of drum 504 via process volume 520 of vacuum chamber 504 to the transfer section 510. The guiding means 554/and or inner wall 548 of transfer section 510 may comprise a tube extending into process volume 520, optionally with a chute and/or feed/outlet hopper. In one example, the guiding means may comprise a continuous structure forming a tube in a section near to opening 518 of the drum 504 and forming an open chute or channel in a section near to the opening 555 for guiding the particles into the transfer section 510.

Transfer section 510, in particular inner wall/tube 548, is adapted for gravitational transfer of the particles to the discharge section 514. Transfer section 510 also comprises a valve 560 for configurably separating process volumes 524 and 550 from each other.

One or both of discharge section 514 and transfer section 510 may comprise guiding means 556 for guiding the product flow into recipients 558 such as vials, Intermediate Bin Containers ("IBCs"), etc., under closed conditions. Discharge section 514 may further be adapted for providing closed conditions to the product for processes such as filling.

In some embodiments, transfer section 510 is not adapted for cooling inner transfer volume 562, as cooling of the freeze-dried particles may not be necessary. However, as has been discussed for transfer section 508, heating and optionally also cooling equipment may nevertheless be provided to shorten time spans required for a temperature adaptation between different processes. The entire process line 500 may be adapted for CiP/SiP, as illustrated, by incorporation of one or more cleaning/sterilization medium access points 564.

Figure 6:
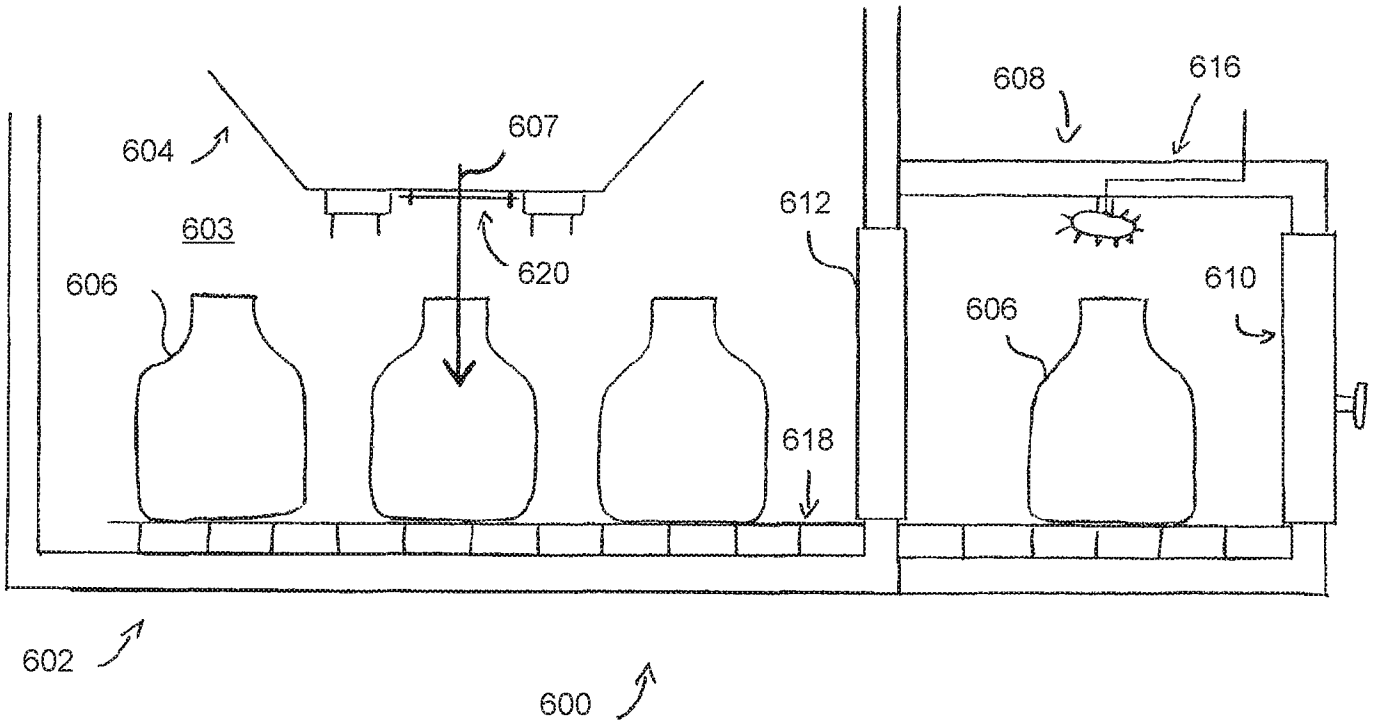
FIG. 6 is a sectional view of a third embodiment of a freeze-dryer according to the invention.

FIG. 6 is a sectional view of a further embodiment 600 of a freeze-dryer in accordance with the invention. In these embodiments, the freeze-dryer 600 comprises vacuum chamber 602 housing a rotary drum 604, wherein the construction and functionalities of these components in many aspects will be similar to those previously described in other embodiments herein. In contrast to embodiment 502 illustrated in FIG. 5, the freeze-dryer 600 is adapted for a direct discharge of the product, i.e., product filling into recipients 606 can be performed under closed conditions within process volume 603 inside vacuum chamber 602, such that the bulk product flow 607 continues through process volume 603 and ends in recipients 606.

In certain embodiments, a sterilization chamber double-gate system 608 can be loaded with one or more IBCs 606 via sealable gate 610. Chamber 608 optionally comprises a further sealable gate 612 which when open allows transfer of IBCs between vacuum chamber 602 and sterilization chamber 608. After loading IBCs 606 from the environment via gate 610 into chamber 608, the IBCs 606 can be sterilized by means of sterilization equipment 616. After sterilization of IBCs 606, gate 612 is opened and IBCs 606 are moved into the vacuum chamber 602 by means of a traction system 618. When closed, gate 612 is configured to preserve sterility and/or containment for the process volume 603 provided by vacuum chamber 602.

In some embodiments, rotary drum 604 can be inclinable and/or can be equipped with a schematically indicated peripheral opening 620, that can be controllable to open for unloading a product batch after drying. The traction system 618 can then move filled IBCs 606 back into chamber 608 for appropriate sterile sealing of the IBCs 606 before unloading them from chamber 608. Appropriate sealing of filled IBCs 606 may alternatively also be performed in the vacuum chamber 602.

Additional embodiments also provide one or more means for sterilizing IBCs 606 within vacuum chamber 602, which may then, for example, be sterilized before the start of a production run and when establishing sterile conditions within process volume 603. Such configuration may be advantageous in case the recipients required for receiving an entire production run can be entirely stored within the vacuum chamber before starting the run, i.e., before establishment of closed conditions. This would require that one or more means are provided within the process volume established by vacuum chamber 602 for sealing the recipients after filling under continuing closed conditions, e.g., within the process volume. While this may come at the cost of added complexity for the freeze-dryer, one may, on the other hand, with a direct discharge facility save extra devices and/or save one or more isolators for discharging and filling. General advantages of using the process volume provided by the housing chamber (vacuum chamber) for direct discharging/filling, rely on that the chamber is adapted for controlling desired process conditions anyway.

In still another embodiment, the process line comprises a docking facility arranged at the housing/vacuum chamber for final recipients. For example, such docking facility is implemented as a modified transfer section such as those 508 and 510 illustrated in FIG. 5. The recipients are docked directly onto a discharge tube protruding into and/or out of the housing chamber (vacuum chamber). In this regard, only the sterility of the inside of the recipients needs to be assured in advance of filling. Sterility needs to be maintained while the recipient(s) is/are in the docked state, i.e., from docking to undocking/sealing the recipient(s).

Regarding cleaning/sterilization of a freeze-dryer in accordance with the invention, and in this respect referring back to FIG. 2, freeze-dryer 200 illustrated therein is arranged on frame 222 via support structures 224. Frame 222 provides for an inclination angle 226 of freeze-dryer 200 with respect to a horizontal orientation. A non-vanishing inclination of chamber 202 and/or condenser 204 can for example be used for implementing a self-draining procedure with respect to the cleaning and/or sterilization processes. In a preferred embodiment, one or more cleaning mediums and/or sterilization mediums or condensates introduced into the vacuum chamber 202 can be drained via connecting tube 206 to condenser 204, where any drain may leave freeze-dryer 200 via port 228. In still other embodiments, the condenser is mounted horizontally (which could mean that the condenser is not self-draining), while only the vacuum chamber may be mounted with a permanent or temporary/adjustable inclination.

In other embodiments, instead of draining via tube 206, the vacuum chamber 202 additionally, or alternatively, comprises a drainage port. As the draining requirement would be released, the tube 206 could be more flexibly designed.

The inclination angle 226 is preferably permanently or temporarily arranged or optionally frame 222 may be adapted for motion through a range of adjustable inclinations 226, e.g., between 0°-45°. A temporary/adjustable inclination 226 may be preferable in some embodiments with regard to product discharge via ports 220 or 218. In the case of an alterable or adjustable inclination, connections to other devices such as transfer section 208, but potentially also tube 206 are themselves flexible or configured such that they too are also suitably alterable/adjustable.

As shown in FIG. 3, drum 302 can also be similarly arranged, with respect to a horizontal line 332, with a non-vanishing inclination angle 334, thus enabling internal volume 312 of drum 302 to be implemented as self-draining regarding cleaning and/or sterilization mediums, sterilization condensates, etc. Drum 302 is configured such that remnants of a cleaning/sterilization process such as liquids and condensates leave the drum 302 to enter into chamber 202. The remnants may then leave vacuum chamber 202 via tube 206, as described above. As illustrated in FIG. 3, inclination 330 of drum 304 and inclination 226 of vacuum chamber 202 can be chosen to be generally mutually opposite to each other, i.e., drum and chamber are inclined in opposite directions. This is contemplated to provide for greater design flexibility including particularly compact freeze-dryer designs. Drum 302 can be permanently inclined by given inclination angle 330, or the inclination 330 may be adjustable, such that, for example, drum 302 is horizontally aligned during freeze-drying and is only selectively inclined, e.g., for a draining of cleaning/sterilization remnants. Generally, the present invention provides for flexible design concepts regarding self-draining capabilities of the freeze-dryer. This aspect of the invention is contemplated to be an important aspect for implementing CiP/SiP concepts.

Figure 7:
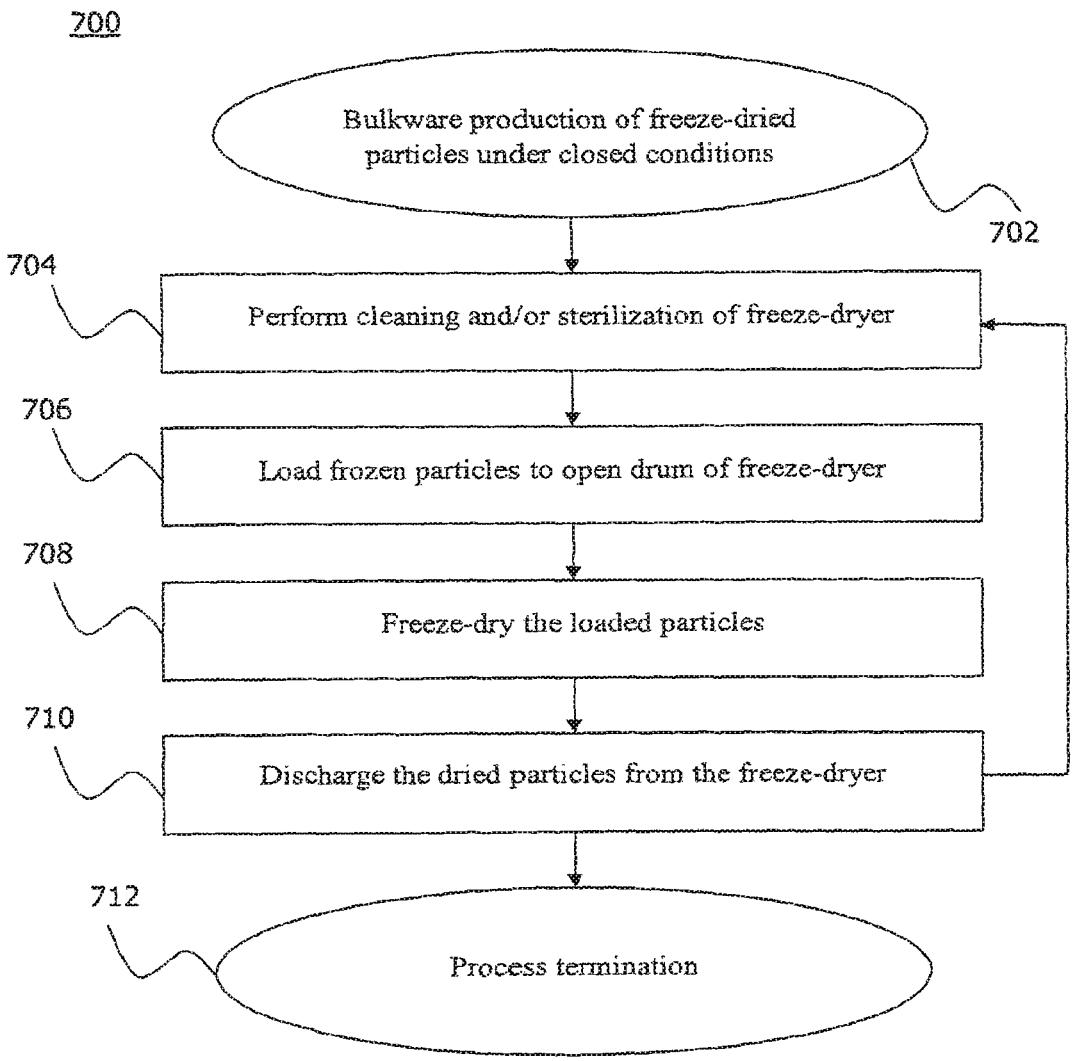
FIG. 7 is a flow diagram illustrating an operation of the freeze-dryer of FIGS. 2, 3.

FIG. 7 illustrates with flow diagram 700 an exemplary embodiment 700 of an operation of the freeze-dryer 200 of FIGS. 2 and 3. Generally, the operation of freeze-dryer 200 relates to a process for the bulkware production of freeze-dried particles under closed conditions (See FIG. 7, 702).

In step 704, cleaning and/or sterilization of at least freeze-dryer 200 is/are performed. In particular, this may include cleaning and/or sterilization of the entire inner wall surface 406 (FIG. 4) of vacuum chamber 202 confining process volume 316 (see FIG. 3) and of drum 302 with outer wall surface 438 and inner wall surface 444 (FIG. 4). In order to prepare for a subsequent production run, for example in order to maintain sterility after sterilization, normally any cleaning and/or sterilization is preferably performed under closed conditions of the vacuum chamber 202. Generally, as one of the aspects related to the provision of hermetic closure or "closed conditions" for a process volume and/or the product processed therein, such hermetic closure includes the sealing of any openings in the wall(s) confining the process volume. These openings can include ports, drilling holes, etc., which are provided for one or more of at least the following: nozzles, sensor circuitry such as, e.g., temperature probes, mountings for sensor elements, a drum support, etc. The openings also include the opening(s) provided for mounting transfer sections such as section 208, which may be provided in the inner walls of vacuum chamber 202, and/or inner/outer walls of drum 302. It is noted that for a hermetic closure concept any provision of power, cooling/heating medium, cleaning/sterilization medium, etc. to internal drum 302 also has to be considered as necessarily eventually traversing the walls of vacuum chamber 202 from the environment 320 and suitable provisions for maintaining "closed conditions" must be taken into account in the design concepts.

Referring further to step 704, cleaning and/or sterilization may comprise controlling the temperature of, for example, the inner wall surface 406 of vacuum chamber 202 and/or of the outer 438 and inner 444 wall surfaces of drum 302. For example, one or more of the wall surfaces may be (pre-) heated in order to reduce mechanical stress thereof when applying steam for sterilization purposes and/or in order to support the sterilization process itself. Remnants of any cleaning/sterilization process can be removed based on a self-draining capability of drum and/or vacuum chamber such as illustrated exemplarily in FIGS. 2, 3, or by other suitable means.

In step 706, frozen particles are loaded into the drum 302 of freeze-dryer 200. The particles can be received from any particle generator adapted for producing frozen particles such as pellets, granules, etc. A continuity of the hermetic closure conditions as established in step 704 preferably is ensured in process volume 316 of freeze-dryer 200. For example, maintaining closed conditions within process volume 316 can be determined at regular time intervals (e.g., from 1, 2, 3, 4, 5, 10, 20, 30, 40, 50, 60, and intervening units of time, which include seconds, minutes, hours, and days, etc.). The production run 700 can be interrupted if any violation of closure conditions (or other process conditions or specifications) is detected, including, but not limited to, unwanted opening operation of sealed valves, transfer sections, etc.

In preferred embodiments, during the loading step 706, at least the process volume portion 312 internal to drum 302 can be controlled in order to provide optimum conditions for the particles received therein. For example, besides keeping the particles in a frozen state, in case of a loading process continuing during a time span of a particle generation in an upstream particle generator, one of the corresponding requirements may comprise preventing an agglomeration of the received particles before drying.

Consequently, the loading step 706 may generally comprise an active temperature control of process volume 316 via cooling of walls 318 and 330 of vacuum chamber and/or drum. For example, as the walls may have been heated to high temperatures during the CiP/SiP step 704, in order to shorten the cooling times thereof, an active cooling of the walls of vacuum chamber and/or drum can be performed prior to initiating the loading of the particles. In a further example, active cooling can be employed to reduce cooling times after sterilization from 6-12 hours (or more) down to 1 hour (or less). A cooling may continue in order to provide an optimum temperature at least within internal volume 312 of drum 302 for receiving the particles therein and minimizing agglomeration thereof.

In some embodiments, in order to provide the desired cooling, the walls 318 of vacuum chamber 202 can be cooled accordingly. In this regard, drum 302 can be equipped with additional cooling equipment, and the drum can itself contribute to cooling. Depending on the amount of cooling required, the details of the freeze-dryer configuration and the control regime thereof, active cooling may alternatively be performed by (walls 330 of) drum 302, while (walls 318 of) vacuum chamber 202 remain passive.

As a further measure to provide efficient cooling to the loaded particles and/or in order to prevent agglomeration thereof, the loading step 706 may comprise providing for a rotation of drum 302. For example, the drum can be kept in continuous or discontinuous rotation, and/or may be rotated constantly or with varying rotation velocities. According to one example, drum 302 can be rotated continuously with a constant velocity which is generally slower than the rotational velocity during drying. One or more predetermined rotational patterns for the drum can be applied, and/or the drum can be rotated in response to a determination of process conditions such as a current load of the drum, humidity (i.e., water vapor content) and temperature within process volume 312, 314, and 316, etc.

In step 708, the particles loaded to the rotary drum are freeze-dried. The vacuum chamber 202 is in charge of providing closed conditions for the product. Protecting sterility and/or providing containment conditions may comprise that transfer section 208 be sealed with respect to the upstream particle generator. Further, the freeze-drying may comprise that a vacuum is established comprising predefined low pressure conditions within process volume 314 of vacuum chamber 202 via action of vacuum pump 207 and, as drum 302 carrying the particles is in open communication, also drum-internal portion 312 of process volume 316. In preferred embodiments, water vapour evaporating from the particles due to sublimation is drawn out of communicating process volume portions 312 and 314 due to action of condenser 204 and vacuum pump 207.

In order to establish and/or maintain desired process conditions during drying, besides the condenser 204 extracting water vapour, the vacuum pump keeping the pressure at a desired vacuum level, etc., also heating equipment provided for example within walls 318 of vacuum chamber 202 and/or walls 330 of drum 302 can be controlled to actively heat process volume 316 including the particles to be dried to achieve temperatures at a desired level. Depending on details such as the load of drum 302, intensity of the ongoing sublimation process, etc., it may be sufficient that, for example, only walls 330 of drum 304 are heated, e.g., only an inner surface 444 thereof. In an alternative embodiment, the drum is not equipped with heating means in order to limit a complexity of the drum design; in this case only the vacuum chamber, e.g., an inner wall surface thereof, may be operated to heat the confined process volume during lyophilization (and/or still other heating mechanisms, such as microwave heating, can be provided). Such configuration is possible as process volume portions 312 and 314 internally and externally to the particle-carrying drum 302 are in communication with each other. However, a heating performed by the drum may for some embodiments be more efficient in order to achieve a desired temperature for the particles to be freeze-dried.

During freeze-drying, the drum 304 can optionally be rotated in order to maximize product surface available for the direct release of water vapor into process volume 312. For the rotational patterns to be applied during drying, basically similar considerations have to performed as discussed above for the loading step. However, a rotation velocity may in some embodiments be held at a higher velocity than in the loading step. In one example, the drum is kept in a continuous and constant velocity of rotation during freeze-drying. In one embodiment, the freeze-dryer is provided with a variable speed rotary drum according to adaptations of a driving unit for the drum and/or a control procedure thereof, wherein at least two different rotational modes are provided, namely a first mode of (e.g., continuous, slow) rotation to be applied during a loading of particles, and a second (continuous, faster) rotational mode to be applied during freeze-drying of the particles. In still further embodiments, the drum and/or control thereof is adapted to provide for discontinuous (starting and stopping) or multi-velocity rotational motions.

In another embodiment, the rotation velocity is controlled according to, for example, the current status of the lyophilization process. For example, by changing the drum's rotation velocity, the product surface available for direct evaporation can be increased or decreased, which in turn is contemplated to influence process conditions such as humidity and temperature in the process volume. As a result, rotation velocity turns out to be a process parameter that is optionally available for controlling a lyophilization process.

In step 710, freeze-drying of the particles is terminated, for example as it has been detected that the humidity of the particles has been decreased down to a desired level. During a discharging of the particles from the freeze-dryer, the vacuum chamber 202 continues to be responsible for maintaining closed conditions for the product, either until the entire bulk product has been conveyed to a separate discharge section/station (See FIG. 5) or until the particles have been filled directly into final recipients and these are either sealed within the vacuum chamber or removed from the vacuum chamber via a gate into a separate sealing chamber (See FIG. 6) or isolator.

An active temperature control may or may not be required in the discharging step, as the dried particles do not normally require cooling following drying. However, after discharging has been completed, a heating may be applied in order to match conditions inside process volume 316 of vacuum chamber 202 with an environment prior to, for example, a removal of filled (and sealed) recipients from the vacuum chamber 202.

In step 712 the process 700 is terminated. This may entail that closed conditions need no longer be maintained. Active heating can be performed utilizing heating equipment associated with the vacuum chamber 202 and/or the drum 302, for example in order to prepare a subsequent cleaning/sterilization process on short timescales. As is intended to be indicated by arrow 714, after a cleaning/sterilization, freeze-dryer 200 can be immediately involved in a next production run. Additionally, or alternatively, maintenance operations such as checking sensor circuitry and other control equipment, etc., can be performed at this time.

According to particular embodiments of the invention, a freeze-dryer comprises a housing with an internal rotating drum. The housing, implemented for example as a vacuum chamber, is adapted to provide for closed conditions, and therefore the freeze-dryer can be operated for producing a sterile product in a non-sterile environment. In some embodiments, the freeze-dryer may further comprise fully contained charging and discharging means. An inclined charging tube can optionally reach into the drum for continuously charging particles such as micropellets during a particle generation process such as prilling, spray-freezing, etc., into the rotating drum to keep the product there within in movement during charging/loading.

Embodiments of the freeze-dryer as discussed herein can beneficially be used for freeze-drying of, for example, sterile free-flowing frozen particles as bulkware. Use of a rotary drum for receiving the particles allows significantly reduced drying times compared to, e.g., tray- and/or vial-based dryers, as with an increased product surface mass and heat transfer can be accelerated. Heat transfer need not take place through the frozen product, and the layers for diffusion of water vapor are smaller compared to, e.g., drying in vials, wherein stoppers may be required. No adaptation to specific vials/stoppers allowing a vapour passage is required, for example because no vials/stoppers are utilized. Homogenous drying conditions for the entire batch can be provided.

Providing temperature-controlled wall surfaces in particular for cooling is contemplated to, for example, lessen the demand for sterile cooling media such as sterile liquid nitrogen or silicone oil, thereby contributing to the cost-efficiency of the freeze-dryer and/or a process including the freeze-dryer.

The freeze-dryer can be adapted for CiP/SiP, for example, the housing can be steam-sterilizable. The housing/vacuum chamber and/or the drum can be inclined/inclinable in order to support the draining of liquids/condensates and/or the discharge of the product. For discharging the product, the housing/vacuum chamber may comprise guiding/discharging elements for guiding particles after unloading from the drum either into a final recipient or via a transfer section including a discharge funnel to a separate discharge section.

Embodiments of a freeze-dryer as described herein allow an operation in a non-sterile environment for manufacturing a sterile product. This avoids the necessity for employing an isolator for achieving closed conditions, which implies that freeze-dryers according to the invention are not limited with regard to available isolator sizes. Further corresponding advantages include lessened analytical requirements. Costs may be considerably reduced while maintaining conformity with requirements of GMP, Good Laboratory Practice ("GLP"), and/or Good Clinical Practice ("GCP"), and international equivalents.

Although, in preferred embodiments, isolator(s) is/are not required for closed operation, in preferred embodiments a freeze-dryer according to the invention clearly constitutes a well-defined, separate process device devoted to the task of freeze-drying under closed conditions, which is to be seen in contrast to highly integrated devices specifically adapted for implementing multiple tasks within one device, e.g., particle generation and drying. For example, if connected via, e.g., transfer sections as described herein in a process line, the freeze-dryer can be adapted for separated operations under closed conditions, including at least one of freeze-drying, cleaning of the freeze-dryer, and sterilization of the freeze-dryer. The freeze-dryer according to the invention may thus flexibly be employed and/or optimized for freeze-drying as desired. Optimizations may relate, for example, to the provision and design of cooling and/or heating equipment in association with the housing/vacuum chamber and/or the drum.

The products to be freeze-dried can be based on virtually any formulation which is suitable also for conventional (e.g., shelf-type) freeze-drying processes, for example, monoclonal antibodies, other protein-based APIs (Active Pharmaceutical Ingredients), DNA-based APIs, cell/tissue substances, vaccines, APIs for oral solid dosage forms such as APIs with low solubility/bioavailability, fast dispersable oral solid dosage forms like ODTs, orally dispersable tablets, stick-filled adaptations, etc.

Embodiments of a freeze-dryer according to the invention may be employed for the generation of sterile, lyophilized and uniformly calibrated particles such as pellets or micropellets as bulkware. The resulting product can be free-flowing, dust-free and homogenous. Such product has good handling properties and could be easily combined with other components, wherein the components might be incompatible in a liquid state or only stable for a short time period and not suitable for conventional freeze-drying.

While the current invention has been described in relation to various embodiments thereof, it is to be understood that this description is for illustrative purposes only.

This application claims priority of European patent application EP 11 008 058.7-1266, the subject-matters of the claims of which are listed below for the sake of completeness:

1. A freeze-dryer for the bulkware production of freeze-dried particles under closed conditions, the freeze-dryer comprising a rotary drum for receiving the frozen particles; and a stationary vacuum chamber housing the rotary drum, wherein for the production of the particles under closed conditions the vacuum chamber is adapted for closed operation during processing of the particles, and the drum is in open communication with the vacuum chamber.

2. The freeze-dryer according to item 1, wherein the vacuum chamber comprises a temperature-controllable inner wall surface.

3. The freeze-dryer according to item 2, wherein the vacuum chamber comprises a double-walled housing.

4. The freeze-dryer according to any one of the preceding items, wherein the drum comprises a temperature-controllable inner wall surface.

5. The freeze-dryer according to any one of the preceding items, wherein at least one of the vacuum chamber and the rotary drum are arranged to be self-draining with respect to at least one of a cleaning process and a sterilization process.

6. The freeze-dryer according to any one of the preceding items, wherein drum and chamber are arranged at mutually opposite inclinations.

7. The freeze-dryer according to any one of the preceding items, wherein at least one of the vacuum chamber and the drum are adapted for Cleaning in Place "CiP" and/or Sterilization in Place "SiP", and in particular for steam-based SiP.

8. A process line for the production of freeze-dried particles under closed conditions, the process line comprising a freeze-dryer according to any one of the preceding items.

9. The process line according to item 8, wherein at least one transfer section is provided for a product transfer between a separate device of the process line and the freeze-dryer, and each of the freeze-dryer and the transfer section are separately adapted for closed operation.

10. The process line according to item 9, wherein a first transfer section is provided for a product transfer from a separate device for producing frozen particles to the freeze-dryer, and the first transfer section comprising a charging funnel protruding into the open drum without engagement therewith.

11. The process line according to any one of items 9 or 10, wherein a second transfer section is provided for a product transfer from the freeze-dryer to a separate device for discharging the freeze-dried particles.

12. The process line according to any one of items 9 to 11, wherein the transfer section comprises a temperature-controllable inner wall surface.

13. A process for the bulkware production of freeze-dried particles under closed conditions performed using a freeze-dryer according to any one of items 1 to 7, the process comprising at least the following process steps:

loading frozen particles to the drum of the freeze-dryer;

freeze-drying the particles in the rotary drum which is in open communication with the vacuum chamber of the freeze-dryer; and discharging the particles from the freeze-dryer;

wherein the vacuum chamber of the freeze-dryer is operated under closed conditions during processing of the particles.

14. The process according to item 13, comprising a step of controlling a temperature of a wall of at least one of the vacuum chamber and the drum.

15. The process according to item 13 or 14, wherein the drum is rotated in the loading step with a slower rotation velocity than in the drying step.

What is claimed is:

1. A process line for the production of freeze-dried particles under end-to-end closed conditions suitable for the production of pharmaceuticals, wherein said closed conditions include at least one of protecting sterility of the product and containment of the product, the process line comprising:

a particle generator for producing frozen particles under said closed conditions;

a freeze-dryer for producing freeze-dried particles under said closed conditions, the freeze-dryer comprising a vacuum chamber housing a particle carrier for receiving the frozen particles; and a transfer section for product transfer between the particle generator and the freeze-dryer, wherein said transfer section is adapted to be cooled, wherein for the production of the freeze-dried particles under said closed conditions:

the particle generator is adapted for operation under said closed conditions;

the vacuum chamber is adapted for operation under said closed conditions, and the transfer section is adapted for protecting a sterile product flow, and to operatively separate the freeze-dryer and the particle generator from each other such that at least a first one of the freeze-dryer and the particle generator is operable under said closed conditions separately from a second one of the freeze-dryer and the particle generator, wherein the transfer section comprises a double wall structure including:

an outer wall; and an inner wall with a temperature-controllable inner wall surface;

wherein the transfer section further comprises a controller configured for actively controlling a temperature of the inner wall surface to adapt the transfer section to a process temperature for product transfer.

2. The process line according to claim 1, wherein the transfer section comprises a mechanical component for operatively separating the freeze-dryer and the particle generator from each other, the mechanical component comprising a component selected from a group consisting of a valve, a vacuum lock, and a sealing component.

3. The process line according to claim 2, wherein the mechanical component comprises a vacuum-tight valve.

4. The process line according to claim 1, wherein the particle carrier comprises one or more vibrating trays for receiving the frozen particles as bulkware.

5. The process line according to claim 1, wherein the frozen particles are guided through the transfer section by at least one of: gravity transfer, an auger-based conveyance mechanism, a pressure-based conveyance mechanism, and a pneumatic-based conveyance mechanism.

6. The process line according to claim 1, wherein the outer wall is hermetically closed, and the inner wall comprises one of a funnel, a tube, and a pipe as a guiding component for the frozen particles.

7. The process line according to claim 1, wherein the transfer section comprises access points for cleaning sterilization medium.

8. The process line according to claim 1, wherein the controller is configured for actively controlling a heating of the inner wall surface before at least a cleaning and/or sterilization of the transfer section.

9. The process line according to claim 1, wherein the controller is configured for actively controlling a cooling of the inner wall surface between a cleaning process and a production process.

10. The process line according to claim 1, wherein the controller is configured for actively controlling a cooling of the inner wall surface after cleaning of the transfer section and before at least a product transfer via the transfer section.

11. The process line according to claim 1, wherein the inner wall is actively cooled during at least a product transfer via the transfer section.

12. The process line according to claim 1, wherein the particle carrier comprises one or more stationary trays for receiving the frozen particles.

13. The process line according to claim 1, wherein the vacuum chamber comprises a temperature-controllable inner wall surface.

14. The process line according to claim 13, wherein the vacuum chamber comprises a double-walled housing.

15. The process line according to claim 1, wherein a second transfer section is provided for a product transfer from the freeze-dryer to a separate component of the process line for discharging the freeze-dried particles.

16. A process for the bulkware production of freeze-dried particles under closed conditions performed using a process line for the production of freeze-dried particles under end-to-end closed conditions, the process line comprising:

a particle generator for producing frozen particles under said closed conditions;

a freeze-dryer for producing freeze-dried particles under said closed conditions, the freeze-dryer comprising a vacuum chamber housing a particle carrier for receiving the frozen particles; and a transfer section for product transfer between the particle generator and the freeze-dryer, wherein for the production of the freeze-dried particles under said closed conditions:

the particle generator is adapted for said closed operation;

the vacuum chamber is adapted for said closed operation, and the transfer section is adapted for protecting a sterile product flow, and to operatively separate the freeze-dryer and the particle generator from each other such that at least a first one of the freeze-dryer and the particle generator is operable under said closed conditions separately from a second one of the freeze-dryer and the particle generator, and wherein the process comprises at least the following process actions:

transferring frozen particles from the particle generator via the transfer section to the particle carrier of the freeze-dryer;

freeze-drying the particles in the vacuum chamber of the freeze-dryer;

discharging the particles from the freeze-dryer, and actively controlling the temperature of an inner wall surface of an inner wall of the transfer section to adapt the transfer section to a process temperature for product transfer via the transfer section.

17. The process according to claim 16, wherein said actively controlling comprises actively controlling a cooling of the inner wall surface to adapt the transfer section to the process temperature for product transfer.

18. The process according to claim 16, further comprising actively controlling a cooling of the inner wall surface after a cleaning and before at least the product transfer.

19. The process according to claim 16, further comprising actively controlling a heating of the inner wall surface before at least a cleaning and/or sterilization of the transfer section.

20. The process line according to claim 16, further comprising actively, controlling a cooling of the inner wall surface between a cleaning process and a production process.

21. The process according to claim 16, wherein the vacuum chamber of the freeze-dryer is operated under said closed conditions during processing of the frozen particles.

22. The process according to claim 16, comprising controlling a temperature of a wall of the vacuum chamber.

* * * * *